US005982088A

United States Patent [19]

Hamada et al.

[11] Patent Number: 5,982,088

[45] Date of Patent: Nov. 9, 1999

[54] CERAMIC CATHODE FLUORESCENT DISCHARGE LAMP

[75] Inventors: Munemitsu Hamada, Ichikawa; Akira Takeishi, Narita; Haruo Taguchi, Nishimemachi; Takeshi Masuda, Narita; Yasutoshi Yamaguchi, Yokohama, all of Japan

[73] Assignee: TDK Corporation, Tokyo, Japan

[21] Appl. No.: 08/945,881

[22] PCT Filed: Apr. 23, 1997

[86] PCT No.: PCT/JP97/01399

§ 371 Date: Nov. 13, 1997

§ 102(e) Date: Nov. 13, 1997

[87] PCT Pub. No.: WO97/48121

PCT Pub. Date: Dec. 18, 1997

[30] Foreign Application Priority Data

Jun. 12, 1996 [JP] Japan ..... 8-172920

[51] Int. Cl.[6] ..... H01J 1/62

[52] U.S. Cl. ..... 313/491; 313/346 R; 313/346 DC; 313/631; 313/632

[58] Field of Search ..... 313/491, 346 R, 313/346 DC, 631, 632

[56] References Cited

U.S. PATENT DOCUMENTS

| | | | |
|---|---|---|---|
| 3,505,553 | 4/1970 | Piree | 313/346 |
| 4,882,520 | 11/1989 | Tsunekawa et al. | 313/643 |
| 5,654,606 | 8/1997 | Weijtens et al. | 313/491 |
| 5,814,937 | 9/1998 | Mehrotra et al. | 313/631 |
| 5,841,222 | 11/1998 | Heuvelmans et al. | 313/345 |

FOREIGN PATENT DOCUMENTS

| | | |
|---|---|---|
| 2-174096 | 7/1990 | Japan . |
| 2-186527 | 7/1990 | Japan . |
| 2-186550 | 7/1990 | Japan . |
| 6-132011 | 5/1994 | Japan . |
| 6-267404 | 9/1994 | Japan . |
| 7-296768 | 11/1995 | Japan . |
| 8-102288 | 4/1996 | Japan . |
| 9-129177 | 5/1997 | Japan . |

*Primary Examiner*—Sandra O'Shea
*Assistant Examiner*—Ronald E. DelGizzi
*Attorney, Agent, or Firm*—Nikaido Marmelstein Murray & Oram, LLP.

[57] ABSTRACT

A ceramic cathode fluorescent discharge lamp is provided including a pair of electrodes, a bulb plated with a fluorescent body on an inner surface of same, at least one of said pair of electrodes being a ceramic cathode having a bottomed cylindrical housing including an electron emission material of an aggregate type porous structure of conductive oxide having a first component consisting of at least one of Ba, Sr, and Ca, a second component consisting of at least one of Zr and Ti, and a third component consisting of at least one of Ta and Nb, said aggregate type porous structure having a surface plated with a conductive or semiconductive layer of at least one of carbide, nitride and oxide of Ta or Nb, rare gas being sealed in said bulb, and sealing pressure of said rare gas being in the range between 10 Torr and 170 Torr.

5 Claims, 20 Drawing Sheets

CERAMIC CATHODE FLUORESCENT DISCHARGE LAMP

FIELD OF THE INVENTION

The present invention relates to a small sized fluorescent discharge lamp used as a back light in a liquid crystal display device, and/or a light source for reading in a facsimile device or a scanner.

BACKGROUND OF THE INVENTION

Lately, interest in a liquid crystal display device (LCD) has rapidly progressed because of its low power consumption, small size and light weight. Thus, a small sized fluorescent discharge lamp has been developed as a light source for a liquid crystal display. Similarly, interest in a fluorescent lamp which is compatible with a socket of an incandescent lamp has progressed because of low power consumption and long life as compared with an incandescent lamp.

Fluorescent lamps are classified as hot cathode fluorescent discharge lamps using arc discharge by hot electron emission, and cold cathode fluorescent discharge lamps using glow discharge by secondary electron emission. A hot cathode fluorescent discharge lamp has a lower cathode fall voltage and higher light efficiency for the input power used than does a cold cathode fluorescent discharge lamp. Further, the former has higher luminance because of hot electron emission, and higher luminance is obtained as compared with a cold cathode discharge lamp. Therefore, a hot electron discharge lamp is suitable as a light source which provides a large amount of light flux, like a light source for a back light in a large screen liquid crystal display device, a fluorescent lamp in the shape of an incandescent lamp, a light source for reading in a facsimile device and a scanner. In a prior hot cathode lamp, a fluorescent lamp having a cathode made of a tungsten (W) coil plated with a part of transition metal and an alkaline earth metal including Barium (Japanese patent laid open 59-75553), and a cathode having a porous tungsten impregnated by an electron emission material including barium aluminate (Japanese patent laid open 63-24539) are known.

Because liquid crystal display devices are small and thin, the lamp itself must be thin. However, in a hot cathode lamp in which preheating is essential, a thin structure, like a cold cathode lamp is difficult to accomplish. A thin structure which has no preheating, as shown in Japanese patent laid open 4-73858, has the disadvantage of short lifetime. Further, the deterioration of a cathode because of ion sputtering in which Hg ions and/or Ar ions generated during discharge operations collide with a cathode and splashing of electron emission material occurs. Thus, electron emission material is exhausted during discharge operation, and stable arc discharge for a long time period is impossible. Further, splashed electron emission material is attached on an inner surface of a tube, which is then colored black, so that light flux is decreased rapidly.

The present inventors have proposed a fluorescent lamp having a ceramic cathode in Japanese patent publication 6-103627, a thin tube and high luminance hot cathode fluorescent lamp having an improved lifetime by preventing sputter and evaporation of ceramic cathode material in Japanese patent laid open 2-186550, and a ceramic cathode in which transition from glow discharge to arc discharge is starting time is easy in Japanese patent laid opens 4-43546 and 6-267404.

Those hot cathode discharge lamps have the advantage that transition from glow discharge to arc discharge is easy, and have long lifetime, however, it is still insufficient for the request of 5–6 thousand hours lifetime.

In those prior fluorescent lamps having a ceramic cathode, with an inner diameter of 2.0 mm, and Ar gas with pressure of 5 Torr, the lifetime on average is short, up to around 1000 hours, when lamp current is 15 mA.

SUMMARY OF THE INVENTION

An object of the present invention is to provide a fluorescent discharge lamp having a ceramic cathode, excellent discharge starting characteristics for a long time from initial time to end of lifetime, thin tube structure, high luminance, and long lifetime.

In order to achieve the above object, the present invention provides a fluorescent discharge lamp having a ceramic cathode with rare gas of Ar, Ne, Kr, or Xe or mixture of the same, with sealing pressure 10–170 Torr.

Preferably, said ceramic cathode comprises a first component including at least one of Ba, Sr and Ca present in an amount of x mole ratio in the form of BaO, SrO and CaO, respectively, a second component including at least one of Zr, and Ti present in an amount of y mole ratio in the form of $ZrO_2$ and $TiO_2$, respectively, and a third component including at least one of Ta and Nb present in an amount of z mole ratio in the form of $(½)(Ta_2O_5)$ and $(½)(Nb_2O_5)$, respectively, wherein $0.8=<x/(y+z)=<2.0$, $0.05=<y=<0.6$, and $0.4=<z=<0.95$, and said cathode is in the form of granulated grain with the surface having at least one of carbide and nitride of Ta or Nb, with diameter 20 $\mu$m –300 $\mu$m, mounted in a conductive housing.

The present fluorescent discharge lamp has advantages that electron emission material does not splash out or evaporate even when inner diameter of a lamp is small and operational temperature is high, excellent discharge starting characteristics from start time to end of lifetime, high luminance, and long lifetime.

BRIEF DESCRIPTION-OF THE DRAWINGS

FIG. 1A shows a structure of a discharge lamp in which the present invention is used, FIG. 1B shows a structure of a system in which the present discharge lamp is used for a back light in a liquid crystal display device, FIGS. 1C and 1D show an enlarged view of ends of a discharge lamp of the present invention, FIG. 1E shows a structure of ceramic cathode mounting electron emission material in the form of a porous aggregate type, FIGS. 2(A and B) through 14 (A and B) show experimental results of relations between sealing pressure, and lifetime and luminance of a lamp, FIG. 15 shows the relationship in the present invention between sealing pressure of Ar, and arc discharge lifetime, FIG. 16 shows the relationship in the present invention between sealing pressure of Ar, and luminance at surface of a lamp, FIG. 17 shows the relationship in the present invention between lamp current and arc discharge lifetime, FIG. 18 shows steps of producing electron emission material and a ceramic cathode, and FIG. 19 shows the relationship in the present invention between average diameter of granulated grain in a ceramic cathode, and lifetime $t_1$, of a lamp.

DESCRIPTION OF THE PREFERRED EMBODIMENTS

1. General Explanation of a Discharge Lamp

FIGS. 1A through 1E show a discharge lamp which the present invention is applied to.

FIG. 1A shows a discharge lamp 30, which has an elongate bulb 4 with a pair of ceramic cathodes 1 at both the ends. The cathode 1 receives alternating voltage (for instance 30 KHz) through a lead line from an external circuit, then, rare gas ions in the bulb bombard the ceramic cathode (granulated grain) to generate heat and emit hot electrons resulting in discharge in the discharge space 50 and the fluorescent element plated in the bulb 4 emits light. The emitting light 107 is transmitted through the wall of the bulb 4.

FIG. 1B shows the structure when a discharge lamp of FIG. 1A is used as a back light for a liquid crystal display device.

The lamp 30 has a reflector 104. The light of the lamp 30 enters into a light guide 105 having a reflector 106 which reflects light towards the upper portion of the figure. The reflected light is distributed by the distributor 108, which provides output light 110. The output light 110 functions to illuminate the rear surface of a liquid crystal display device.

FIG. 1B shows the situation in which a single lamp is provided at one side of a light guide. One alternative is that a pair of lamps are provided at both the sides of the light guide.

FIGS. 1C and 1D show an enlarged view of one of the ends of a discharge lamp, and FIG. 1E shows an enlarged view of a ceramic cathode 1 which has a cylindrical cathode housing 2 which has a bottom, and contains aggregate porous elements 3. In those figures, the numeral 4 is a bulb which is made of an elongate glass tube. The inner surface of the tube is plated with fluorescent substance. A conductive lead line 9 is coupled with the ends of the bulb 4.

The lead line 9 has an enlarged space 10 surrounded by a conductive pipe 6 the outer surface of which faces towards the discharge space. The conductive pipe 6 has a ceramic cathode 1 so that an opening of said ceramic cathode 1 faces the discharge space. Thus, the ceramic cathode 1 is fixed to the lead line 9 through the conductive pipe 6. Further, the conductive pipe 6 has a metal pipe 7 having a mercury dispenser 8 arranged between the enlarged space 10 and the ceramic cathode 1.

The mercury dispenser 8 in the conductive pipe 6 has a plurality of slits or openings 11 so that mercury gas in the mercury dispenser 8 is provided into the discharge space through said openings 11.

It is preferable that the electrode housing 2, which is cylindrical with a bottom, is made of material similar to that of the emitting electron emit material in a ceramic cathode so that the electron emitting material contacts strongly with the electrode housing 2.

The size of the electrode housing 2 is, for instance, 0.9 mm for the inner diameter, 1.4 mm for the outer diameter, and 2.0 mm for the length, or 1.5 mm for the inner diameter, 2.3 mm for the outer diameter, and 2.0 mm for the length.

The bulb 4 is filled with Argon gas having about 70 Torr pressure for firing a lamp.

2. Discharge Gas and Pressure

The Tables 1 through 13 show the experimental results of the arc discharge lifetime and luminance at lamp surfaces for each gas pressure when Ar, Ne, Kr, Xe or mixtures of those gases are used for discharge-starting a lamp.

The lamp used for the experiment has a 4 mm outer diameter, a 3 mm inner diameter and a 100 mm length, with three wavelength type fluorescent substances with chromaticity x=0.3 and y=0.3. The ceramic cathode has a conductive housing with a 1.5 mm inner diameter, a 2.3 mm outer diameter, and a 2.0 mm of length filled with electron emitting material.

The electron emitting material used in the experiment is Sample 18 Table 14 which is described later.

The power supply in the experiment has an alternating voltage of 30 KHz, and 80 volts, and the lamp current is 30 mA.

Tables 1 through 4, and FIGS. 2 through 5 show the situation in which the gas used is:

pure Ar,
pure Ne,
pure Kr,
pure Xe

Tables 5 through 10, and FIGS. 6 through 11 show the situations in which the gas used is:

mixture of Ar (50%)+Ne (50%),
mixture of Ar (50%)+Kr (50%),
mixture of Ar (50%)+Xe (50%),
mixture of Ne (50%)+Kr (50%),
mixture of Ne (50%)+Xe (50%),
mixture of Kr (50%)+Xe (50%)

Tables 11 through 13, and FIGS. 12 through 14 show the situation in which the gas used is:

mixture of Ar(90%)+Ne(10%)
mixture of Ar(10%)+Ne(90%)
mixture of Ar(40%)+Ne(20%)+Kr(20%)+Xe(20%)

The gas pressure in the experiment is 5, 10, 20, 30, 50, 70, 90, 110, 130, 150, 170, and 200 Torr.

The information in Tables 1 through 13 is shown in FIGS. 2 through 14, respectively. In those figures, the horizontal axis shows gas pressure (Torr), and the vertical axis shows the lifetime (hour) of a lamp, or luminance (cd/m$^2$).

TABLE 1

Pure Ar (Argon)

| Sample Number | Gas pressure(Torr) | Life Time (hour), | Luminance (cd/m$^2$) |
|---|---|---|---|
| *1 | 5 | *1500 | 38000 |
| 2 | 10 | 4200 | 39000 |
| 3 | 20 | 6200 | 40000 |
| 4 | 30 | 7000 | 41500 |
| 5 | 50 | 7700 | 43000 |
| 6 | 70 | 8500 | 45000 |
| 7 | 90 | 8200 | 46000 |
| 8 | 110 | 8100 | 45500 |
| 9 | 130 | 7800 | 43500 |
| 10 | 150 | 7500 | 41800 |
| 11 | 170 | 7400 | 40900 |
| 12 | 200 | 6600 | *36900 |

TABLE 2

Pure Ne (Neon)

| Sample Number | Gas pressure(Torr) | Life Time (hour), | Luminance (cd/m$^2$) |
|---|---|---|---|
| *13 | 5 | *800 | *35500 |
| 14 | 10 | 3500 | 38000 |
| 15 | 20 | 4200 | 38500 |
| 16 | 30 | 5200 | 39200 |

TABLE 2-continued

| Pure Ne (Neon) | | | |
|---|---|---|---|
| Sample Number | Gas pressure(Torr) | Life Time (hour), | Luminance (cd/m$^2$) |
| 17 | 50 | 5700 | 39900 |
| 18 | 70 | 6500 | 41100 |
| 19 | 90 | 6600 | 42000 |
| 20 | 110 | 6400 | 39500 |
| 21 | 130 | 6200 | 38700 |
| 22 | 150 | 6000 | 38500 |
| 23 | 170 | 5700 | 38100 |
| 24 | 200 | 4200 | *34500 |

TABLE 3

| Pure Kr (Kription) | | | |
|---|---|---|---|
| Sample Number | Gas pressure(Torr) | Life Time (hour), | Luminance (cd/m$^2$) |
| *25 | 5 | *1000 | 38200 |
| 26 | 10 | 4000 | 39000 |
| 27 | 20 | 5500 | 40000 |
| 28 | 30 | 6200 | 41800 |
| 29 | 50 | 7000 | 44000 |
| 30 | 70 | 8100 | 45000 |
| 31 | 90 | 8000 | 43500 |
| 32 | 110 | 7700 | 42500 |
| 33 | 130 | 7500 | 42000 |
| 34 | 150 | 7300 | 41200 |
| 35 | 170 | 7000 | 40000 |
| *36 | 200 | 5100 | *36000 |

TABLE 4

| Pure Xe (Xenon) | | | |
|---|---|---|---|
| Sample Number | Gas pressure(Torr) | Life Time (hour), | Luminance (cd/m$^2$) |
| *37 | 5 | *1600 | 38500 |
| 38 | 10 | 3800 | 39300 |
| 39 | 20 | 5800 | 40800 |
| 40 | 30 | 6500 | 42600 |
| 41 | 50 | 7500 | 44500 |
| 42 | 70 | 7700 | 44500 |
| 43 | 90 | 7400 | 43000 |
| 44 | 110 | 7100 | 42500 |
| 45 | 130 | 7000 | 42000 |
| 46 | 150 | 6700 | 41200 |
| 47 | 170 | 6600 | 40500 |
| *48 | 200 | 4900 | *37100 |

TABLE 5

| Ar (50%) and Ne (50%) | | | |
|---|---|---|---|
| Sample Number | Gas pressure(Torr) | Life Time (hour), | Luminance (cd/m$^2$) |
| *49 | 5 | *1200 | *36000 |
| 50 | 10 | 3900 | 39000 |
| 51 | 20 | 5700 | 39500 |
| 52 | 30 | 6500 | 40200 |
| 53 | 50 | 7500 | 41000 |
| 54 | 70 | 8300 | 42000 |
| 55 | 90 | 8000 | 41500 |
| 56 | 110 | 7800 | 40500 |
| 57 | 130 | 7600 | 40000 |
| 58 | 150 | 7400 | 38800 |

TABLE 5-continued

| Ar (50%) and Ne (50%) | | | |
|---|---|---|---|
| Sample Number | Gas pressure(Torr) | Life Time (hour), | Luminance (cd/m$^2$) |
| 59 | 170 | 7200 | 38300 |
| *60 | 200 | 6700 | *36300 |

TABLE 6

| Ar (50%) and Kr (50%) | | | |
|---|---|---|---|
| Sample Number | Gas pressure(Torr) | Life Time (hour), | Luminance (cd/m$^2$) |
| *61 | 5 | *1300 | 38500 |
| 62 | 10 | 4100 | 39300 |
| 63 | 20 | 5900 | 41200 |
| 64 | 30 | 6800 | 42100 |
| 65 | 50 | 7500 | 43500 |
| 66 | 70 | 7600 | 41800 |
| 67 | 90 | 7500 | 41200 |
| 68 | 110 | 7300 | 39800 |
| 69 | 130 | 7200 | 39500 |
| 70 | 150 | 7100 | 39300 |
| 71 | 170 | 6900 | 38700 |
| *72 | 200 | 6000 | *37400 |

TABLE 7

| Ar (50%) and Xe (50%) | | | |
|---|---|---|---|
| Sample Number | Gas pressure(Torr) | Life Time (hour), | Luminance (cd/m$^2$) |
| *73 | 5 | *1800 | 38500 |
| 74 | 10 | 4300 | 39000 |
| 75 | 20 | 6500 | 40500 |
| 76 | 30 | 7200 | 41800 |
| 77 | 50 | 7800 | 43000 |
| 78 | 70 | 7400 | 42500 |
| 79 | 90 | 7500 | 42000 |
| 80 | 110 | 7200 | 41700 |
| 81 | 130 | 7200 | 41500 |
| 82 | 150 | 7100 | 40800 |
| 83 | 170 | 7000 | 40000 |
| *84 | 200 | 6300 | *37500 |

TABLE 8

| Ne (50%) and Kr (50%) | | | |
|---|---|---|---|
| Sample Number | Gas pressure(Torr) | Life Time (hour), | Luminance (cd/m$^2$) |
| *85 | 5 | *1300 | *36900 |
| 86 | 10 | 3200 | 39500 |
| 87 | 20 | 4200 | 41000 |
| 88 | 30 | 4800 | 42000 |
| 89 | 50 | 5700 | 43200 |
| 90 | 70 | 6900 | 43300 |
| 91 | 90 | 7800 | 43000 |
| 92 | 110 | 7700 | 42200 |
| 93 | 130 | 7200 | 41100 |
| 94 | 150 | 6900 | 39800 |
| 95 | 170 | 6600 | 38800 |
| *96 | 200 | 6200 | *36900 |

TABLE 9

| Ne (50%) and Xe (50%) | | | |
|---|---|---|---|
| Sample Number | Gas pressure(Torr) | Life Time (hour), | Luminance (cd/m$^2$) |
| *97 | 5 | *1700 | *37200 |
| 98 | 10 | 3700 | 39000 |
| 99 | 20 | 4800 | 41500 |
| 100 | 30 | 5450 | 42000 |
| 101 | 50 | 6200 | 42800 |
| 102 | 70 | 7600 | 42900 |
| 103 | 90 | 7500 | 42600 |
| 104 | 110 | 7200 | 42000 |
| 105 | 130 | 6900 | 41400 |
| 106 | 150 | 6800 | 40300 |
| 107 | 170 | 6400 | 38900 |
| *108 | 200 | 5900 | *36800 |

TABLE 10

| Kr (50%) and Xe (50%) | | | |
|---|---|---|---|
| Sample Number | Gas pressure(Torr) | Life Time (hour), | Luminance (cd/m$^2$) |
| *109 | 5 | *1400 | *37200 |
| 110 | 10 | 3600 | 38200 |
| 111 | 20 | 4900 | 40800 |
| 112 | 30 | 5700 | 42100 |
| 113 | 50 | 6900 | 43500 |
| 114 | 70 | 7800 | 43400 |
| 115 | 90 | 7700 | 42300 |
| 116 | 110 | 7500 | 41500 |
| 117 | 130 | 7100 | 40700 |
| 118 | 150 | 6600 | 39800 |
| 119 | 170 | 6200 | 39000 |
| *120 | 200 | 5200 | *37200 |

TABLE 11

| Ar (90%) and Ne (10%) | | | |
|---|---|---|---|
| Sample Number | Gas pressure(Torr) | Life Time (hour), | Luminance (cd/m$^2$) |
| *121 | 5 | *1300 | *37500 |
| 122 | 10 | 4000 | 38600 |
| 123 | 20 | 5000 | 40700 |
| 124 | 30 | 6100 | 42200 |
| 125 | 50 | 7500 | 43500 |
| 126 | 70 | 8400 | 45000 |
| 127 | 90 | 8200 | 44500 |
| 128 | 110 | 8000 | 44000 |
| 129 | 130 | 7700 | 43500 |
| 130 | 150 | 7400 | 42000 |
| 131 | 170 | 7200 | 41000 |
| *132 | 200 | 6000 | *37500 |

TABLE 12

| Ar (10%) and Ne (90%) | | | |
|---|---|---|---|
| Sample Number | Gas pressure(Torr) | Life Time (hour), | Luminance (cd/m$^2$) |
| *133 | 5 | *900 | *35500 |
| 134 | 10 | 3200 | 38100 |
| 135 | 20 | 4200 | 38400 |
| 136 | 30 | 5250 | 39500 |
| 137 | 50 | 5850 | 40900 |
| 138 | 70 | 6700 | 42200 |
| 139 | 90 | 6900 | 42000 |

TABLE 12-continued

| Ar (10%) and Ne (90%) | | | |
|---|---|---|---|
| Sample Number | Gas pressure(Torr) | Life Time (hour), | Luminance (cd/m$^2$) |
| 140 | 110 | 6500 | 41000 |
| 141 | 130 | 6400 | 40000 |
| 142 | 150 | 6200 | 38700 |
| 143 | 170 | 5900 | 38000 |
| *144 | 200 | 4200 | *36900 |

TABLE 13

| Ar (40%), Ne (20%), Kr (20%) and Xe (20%) | | | |
|---|---|---|---|
| Sample Number | Gas pressure(Torr) | Life Time (hour), | Luminance (cd/m$^2$) |
| *145 | 5 | *1600 | *38500 |
| 146 | 10 | 3900 | 39100 |
| 147 | 20 | 5200 | 40300 |
| 148 | 30 | 6500 | 41500 |
| 149 | 50 | 8000 | 43200 |
| 150 | 70 | 7900 | 43000 |
| 151 | 90 | 7500 | 42500 |
| 152 | 110 | 7500 | 42000 |
| 153 | 130 | 7300 | 41700 |
| 154 | 150 | 7000 | 41300 |
| 155 | 170 | 6900 | 40800 |
| *156 | 200 | 6300 | *37800 |

In the tables, the sample with the symbol (*) falls outside the scope of the present invention, and the data with the symbol (*) is not included in the scope of the present invention.

The arc discharge lifetime is defined as time until a lamp cannot maintain an arc discharge and becomes a glow discharge when the lamp discharges continuously with above condition, and luminance of the lamp surface is expressed by cd/m$^2$ which is used as unit intensity.

The numerical restriction of the present invention is that the arc discharge lifetime is longer than 2000 hours, and luminance is higher than 38000cd/m$^2$. Therefore, samples having an arc discharge lifetime less than 2000 hours, or luminance less than 38000cd/m$^2$ are not in the scope of the present invention.

Accordingly, when Ar is 100% (pure Ar), the sample 1 (pressure is 5 Torr) is not in the present invention because of the arc discharge lifetime, and the sample 12 (pressure is 200 Torr) is not in the present invention because of luminance.

When Ne is 100%, the sample 13 (pressure is 5 Torr) is out of the invention because of the arc discharge lifetime and luminance, and the sample 24 (pressure is 200 Torr) is out of the invention because of luminance.

When Kr is 100%, the sample 25 (pressure is 5 Torr) is out of the invention because of the arc discharge lifetime, and the sample 36 (pressure is 200 Torr) is out of the invention because luminance.

When Xe is 100%, the sample 37 (pressure is 5 Torr) is out of the invention because of the arc discharge lifetime, and 5 the sample 48 (200 Torr) is out of the invention because of luminance.

As for mixture of Ar(50%) and Ne(50%), the sample 49 (pressure is 5 Torr) is out of the invention because of the arc discharge lifetime and luminance, and the sample 60 (pressure is 200 Torr) is out of the invention because of luminance.

As for mixture of Ar(50%) and Kr(50%), the sample 61 (pressure is 5 Torr) is out of the invention because of the arc discharge lifetime, and the sample 72 (pressure is 200 Torr) is out of the invention because of luminance.

As for mixture of Ar(50%) and Xe(50%), the sample 73 (pressure is 5 Torr) is out of the invention because of the arc discharge lifetime, and the sample 84 (pressure is 200 Torr) is out of the invention because of luminance.

As for mixture of Ne(50%) and Kr(50%), the sample 85 (pressure is 5 Torr) is out of the invention because of the arc discharge lifetime and luminance, and the sample 96 (pressure is 200 Torr) is out of the invention because of luminance.

As for mixture of Ne(50%) and Xe(50%), the sample 97 (pressure is 5 Torr) is out of the invention because of the arc discharge lifetime and luminance, and the sample 108 (pressure is 200 Torr) is out of the invention because of luminance.

As for mixture of Kr(50%) and Xe(50%), the sample 109 (pressure is 5 Torr) is out of the invention because of the arc discharge lifetime and luminance, and the sample 120 (pressure is 200 Torr) is out of the invention because of luminance.

As for mixture of Ar(90%) and Ne(10%), the sample 121 (pressure is 5 Torr) is out of the invention because of the arc discharge lifetime and luminance, and the sample 132 (pressure is 200 Torr) is out of the invention because of luminance.

As for mixture of Ar(10%) and Ne(90%), the sample 133 (pressure is 5 Torr) is out of the invention because of the arc discharge lifetime and the sample 144 (pressure is 200 Torr) is out of the invention because of luminance.

As for mixture of Ar(40%), Ne(20%), Kr(20%) and Xe(20%), the sample 145 (pressure is 5 Torr) is out of the invention because of the arc discharge lifetime, and the sample 156 (pressure is 200 Torr) is out of the invention because of luminance.

Other samples with pressure in the range of 10 Torr and 170 Torr are within the scope of the present invention.

The effect of the present invention is described in accordance with FIGS. 15 through 17, when the lamp has Ar as discharge starting gas.

Figure 17:
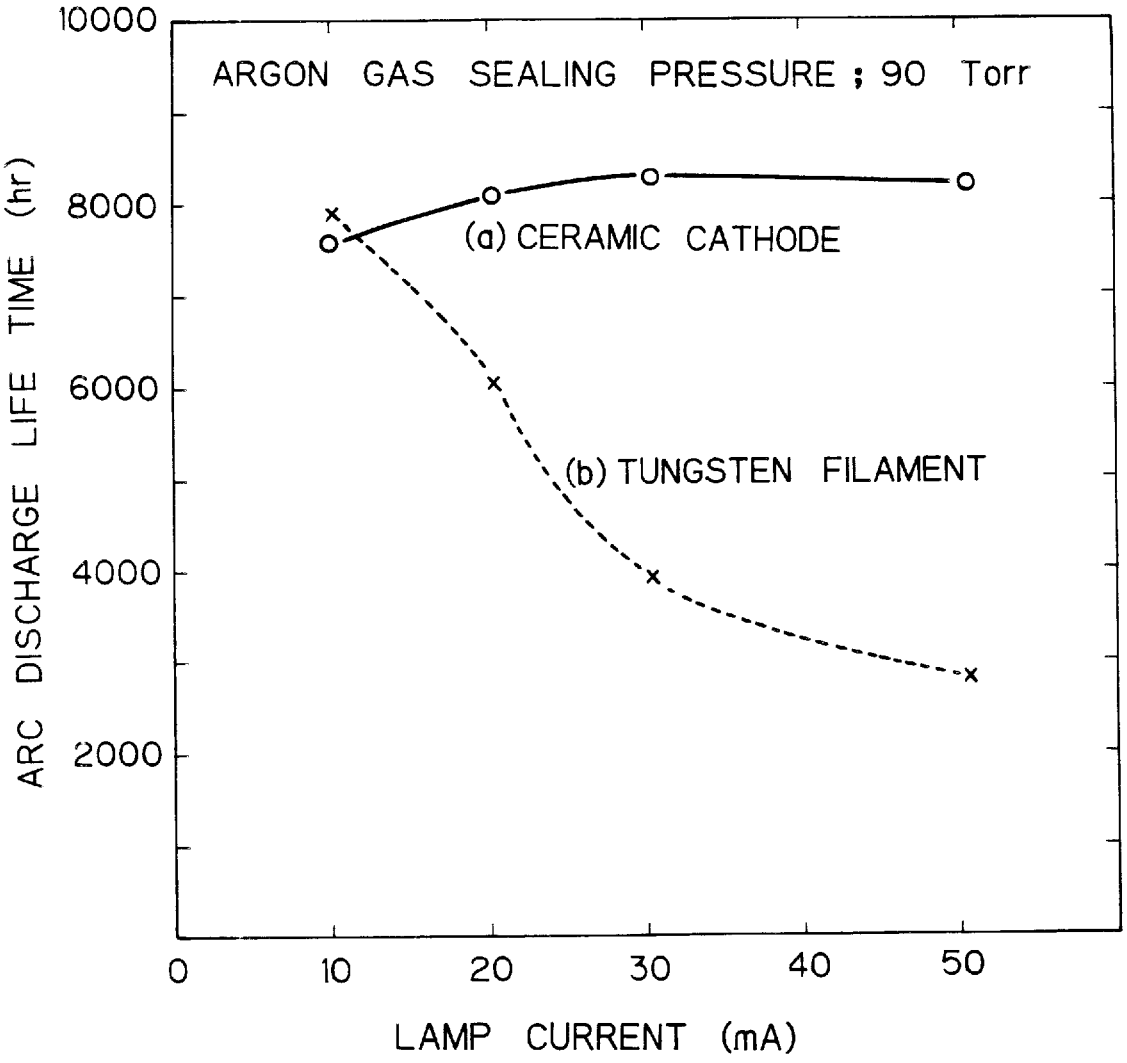
FIG. 17 shows the relationship between lamp current (horizontal axis) and arc discharge lifetime, when the sealing pressure of Ar gas is fixed at 90 Torr.

As shown in FIG. 17,the arc discharge lifetime is longer than 7000 hours when lamp current is in the range between 10 mA and 50 mA. On the contrary, when a cathode is made of tungsten filament as shown in the dotted curve in FIG. 17, the arc discharge lifetime is shorter so that it is 4000 hours for a lamp current of 30 mA, 6000 hours for a lamp current of 20 mA, although it is the same as that of the present invention for lamp current of 10 mA.

3. Structure of a Ceramic Cathode

Figure 18:
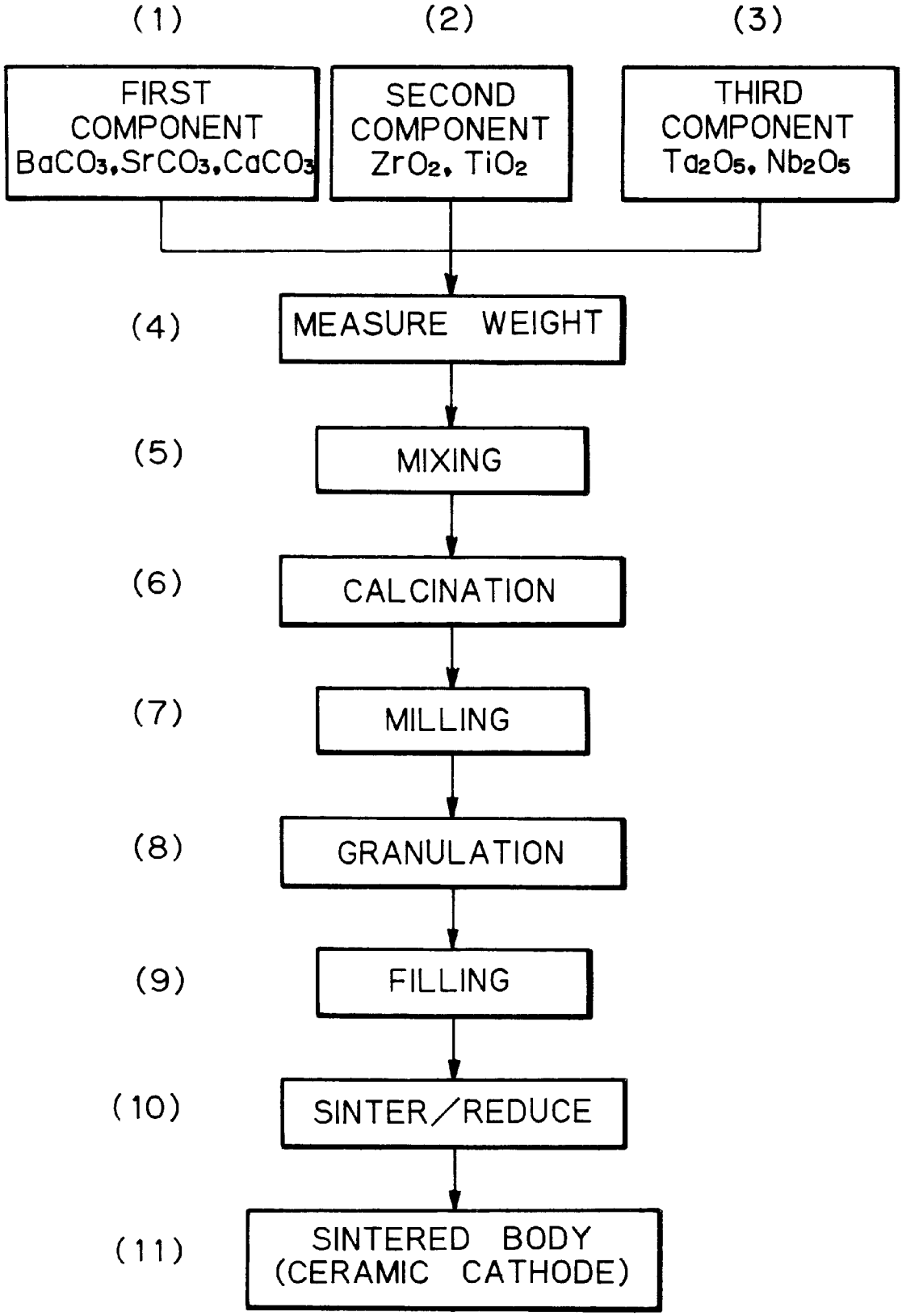

The steps of producing a ceramic cathode is described in accordance with FIG. 18. The producing steps themselves are the same as those of a ceramic in general.

The following starting materials are prepared.

(1) First components comprising $BaCO_3$, $SrCO_3$, $CaCO_3$ in the form of carbonates of Ba, Sr and Ca.

(2) Second components comprising $ZrO_2$ and $TiO_2$ which are oxides of Zr and Ti.

(3) Third components comprising $Ta_2O_5$ and $Nb_2O_5$ which are oxides of Ta and Nb. Other oxides, carbonates, and/or oxalates for above elements are also possible.

(4) Said starting materials (1), (2) and (3) are measured out by weight with a predetermined mixing ratio.

(5) The measured starting materials are mixed through ball milling, friction milling, or coprecipitation. Then, they are dried through a heat-drying process, or a freeze-drying process.

(6) The mixed material is calcined at a temperature of 800° C.–1300° C. The calcining operation may be carried out either for powder material, or formed material.

(7) Calcined material is milled through ball milling to a fine powder.

(8) Said fine powder is processed to granulated grain by using a water solution including a organic binder like polyvinyl alcohol (PVA), polyethylene glycol (PEG), or polyethylene oxide (PEO). The process is carried out for instance through a spray drying method, an extruded grain method, a rotating grain method, or a mortar/pestle method, however, the process for providing granulated grain is not restricted to the above.

(9) A cylindrical electrode housing having a bottom, made of simiconductor ceramics, like $Ba(Zr, Ta)O_3$, which has high melting point and withstands sputtering, is filled with the granulated grain thus obtained, without applying pressure.

(10) The electrode housing filled with the granulated grain is sintered at a temperature 1400° C.–2000° C. The atmosphere during the sintering operation is a reducing gas like hydrogen or carbon monoxide, inactive gas like Argon or nitrogen, or mixture of reducing gas and inactive gas. When the electron emission surface is covered with carbide, a reducing gas like hydrogen or carbon monoxide is preferable.

Figure 1A:
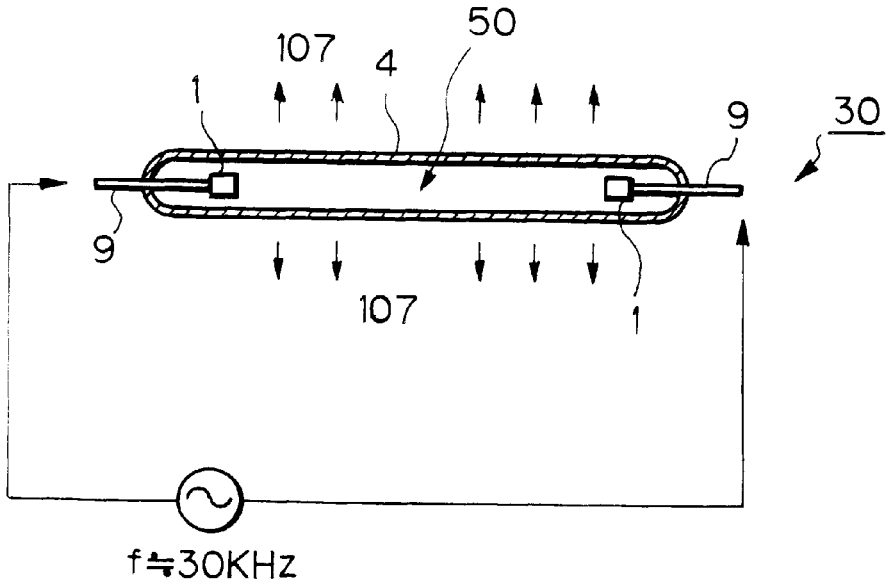
Figure 1B:
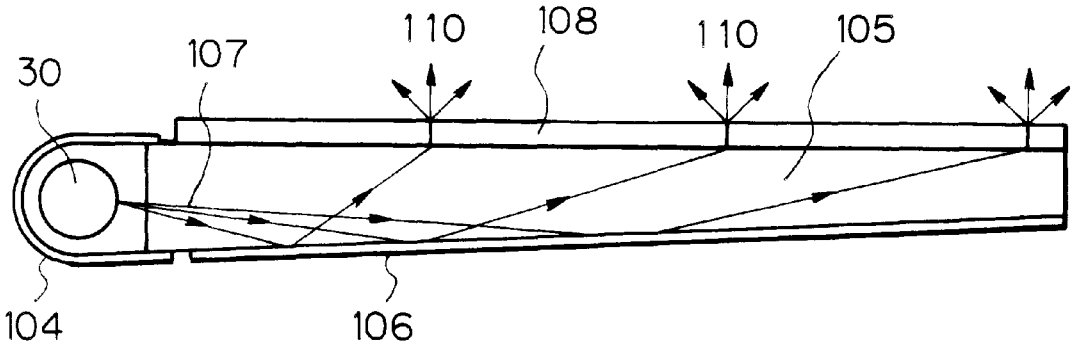
Figure 1C:
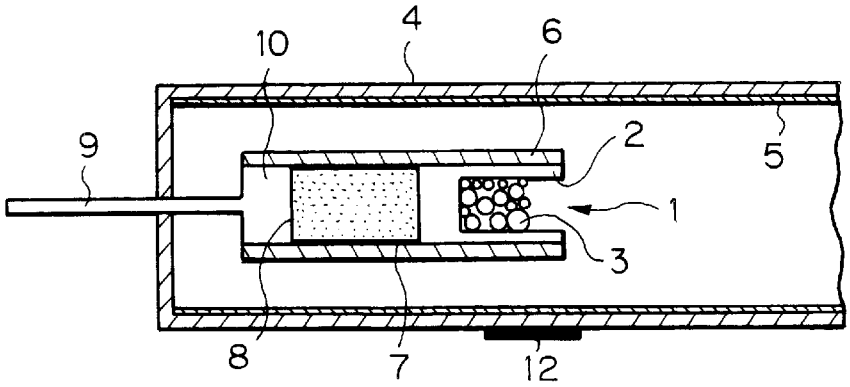
Figure 1D:
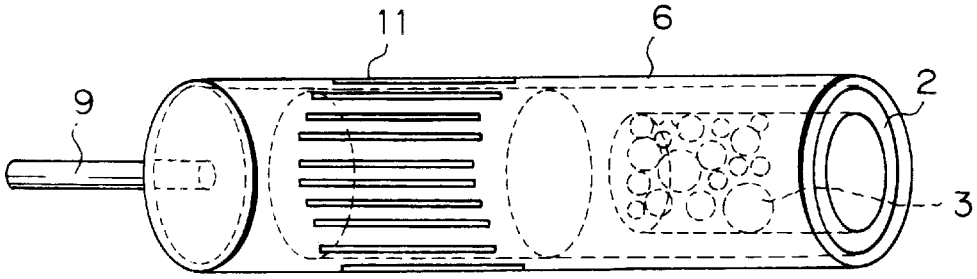
Figure 1E:
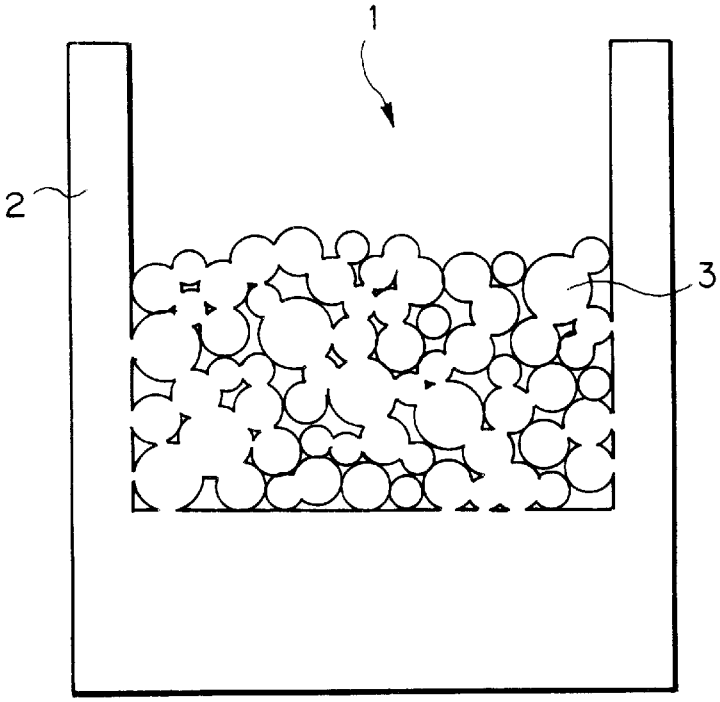
Figure 2A:
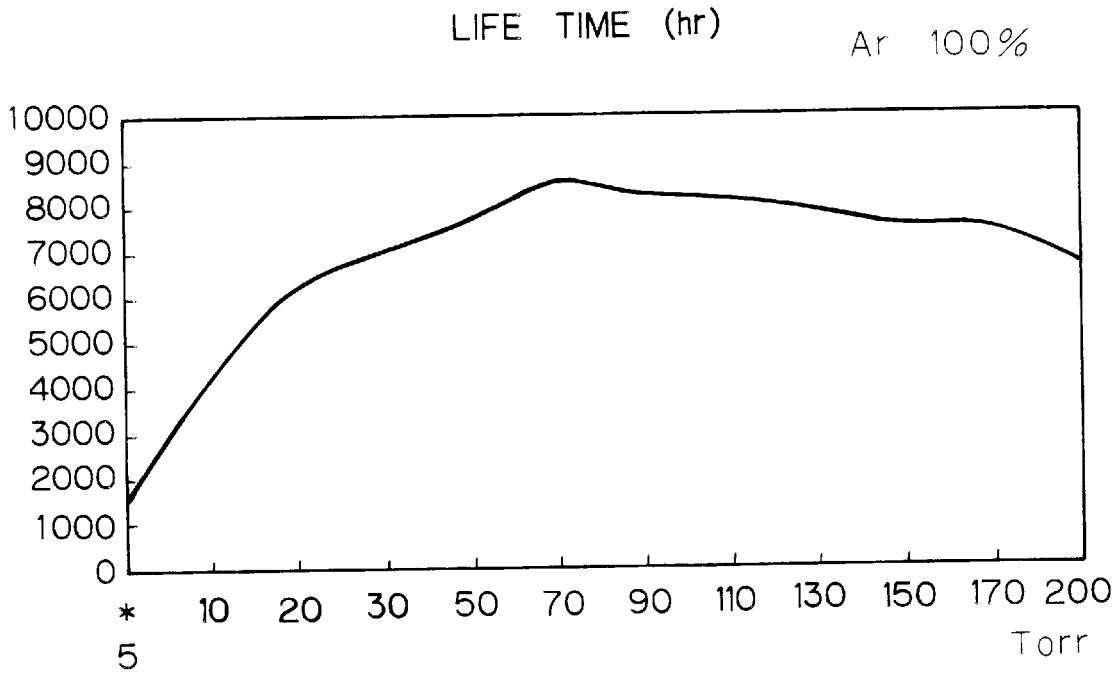
Figure 2B:
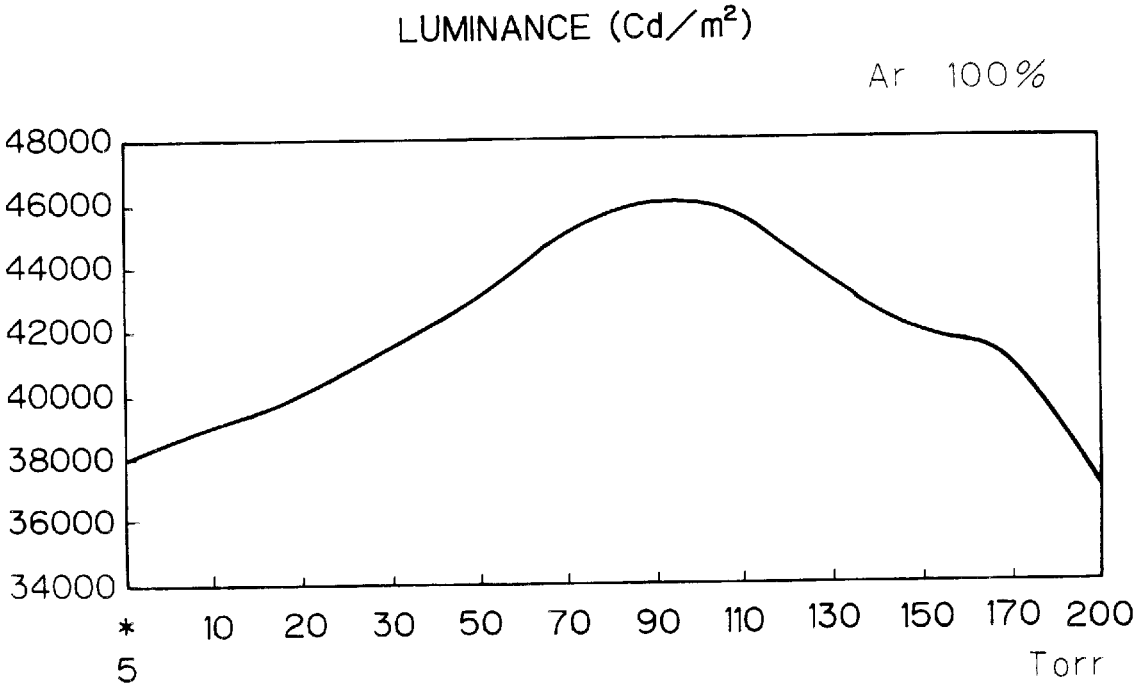
Figure 3A:
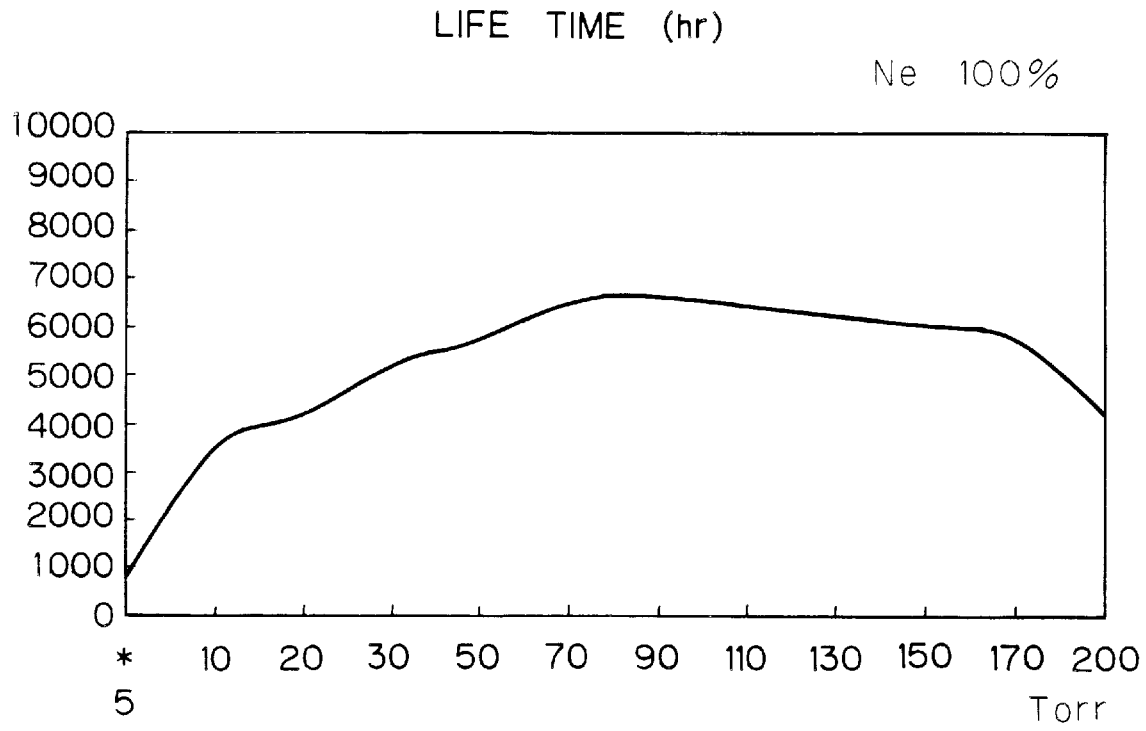
Figure 3B:
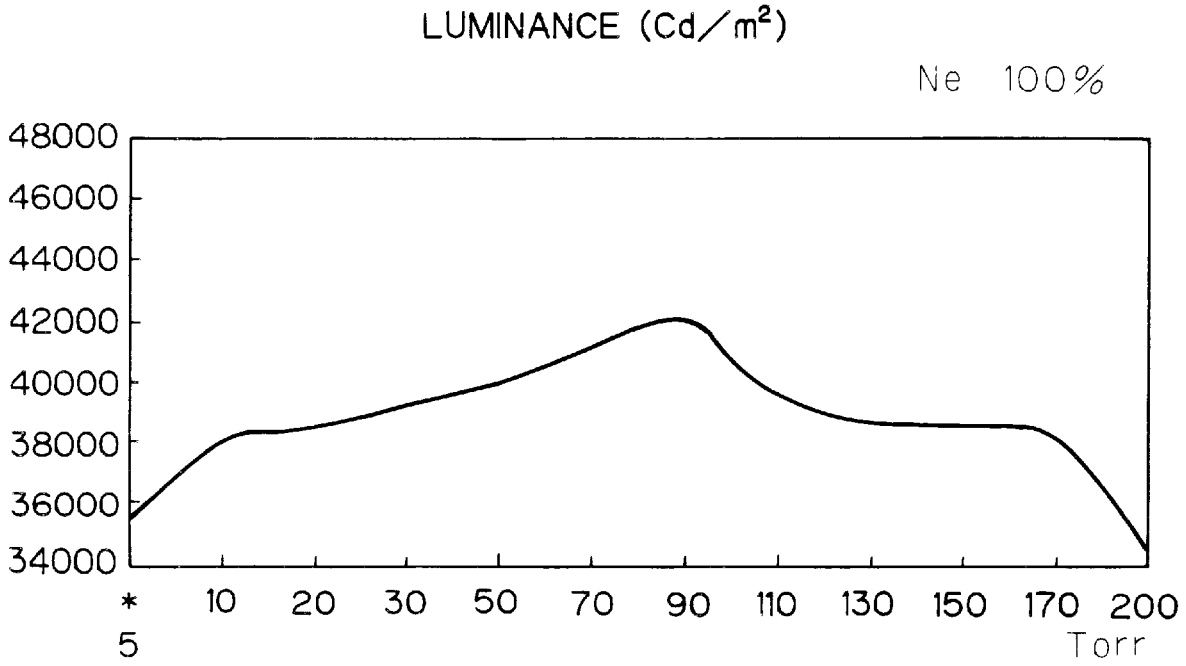
Figure 4A:
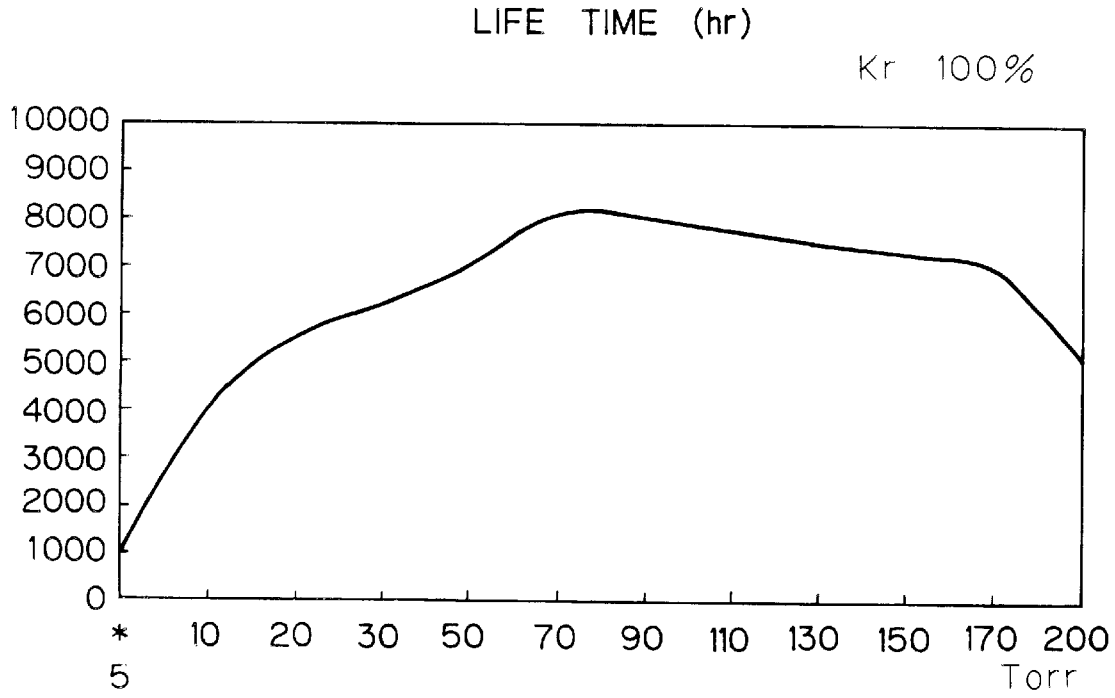
Figure 4B:
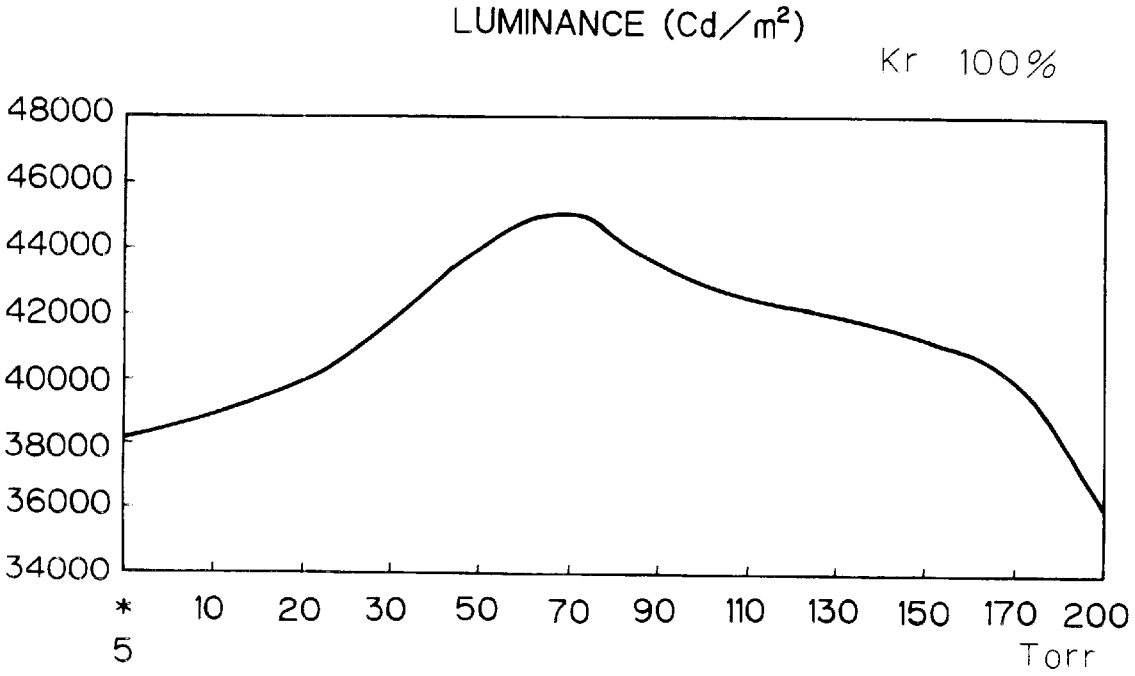
Figure 5A:
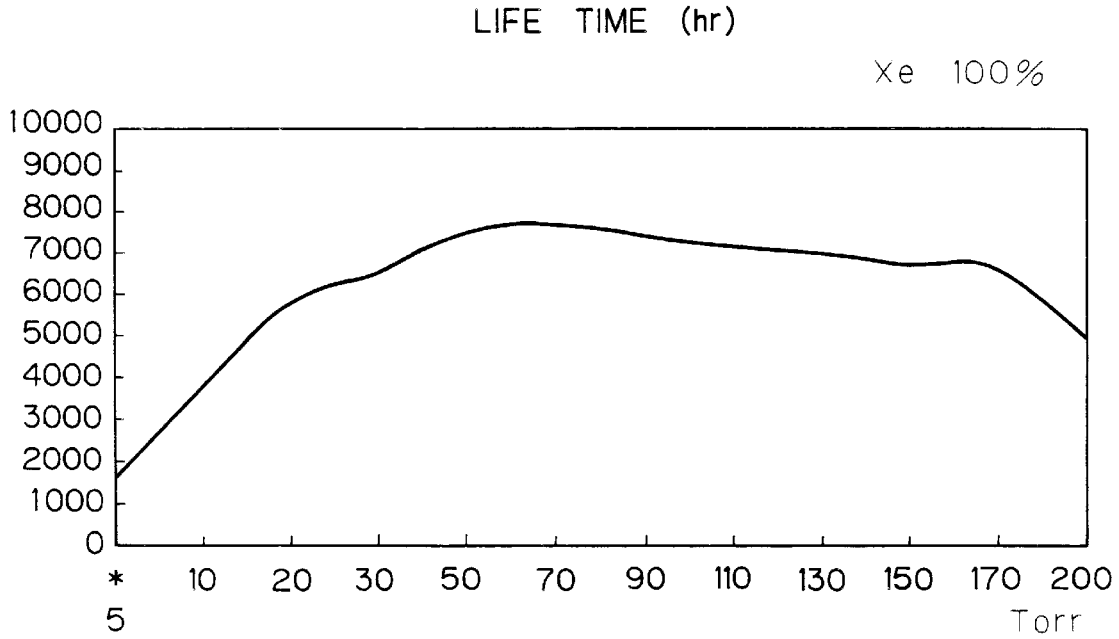
Figure 5B:
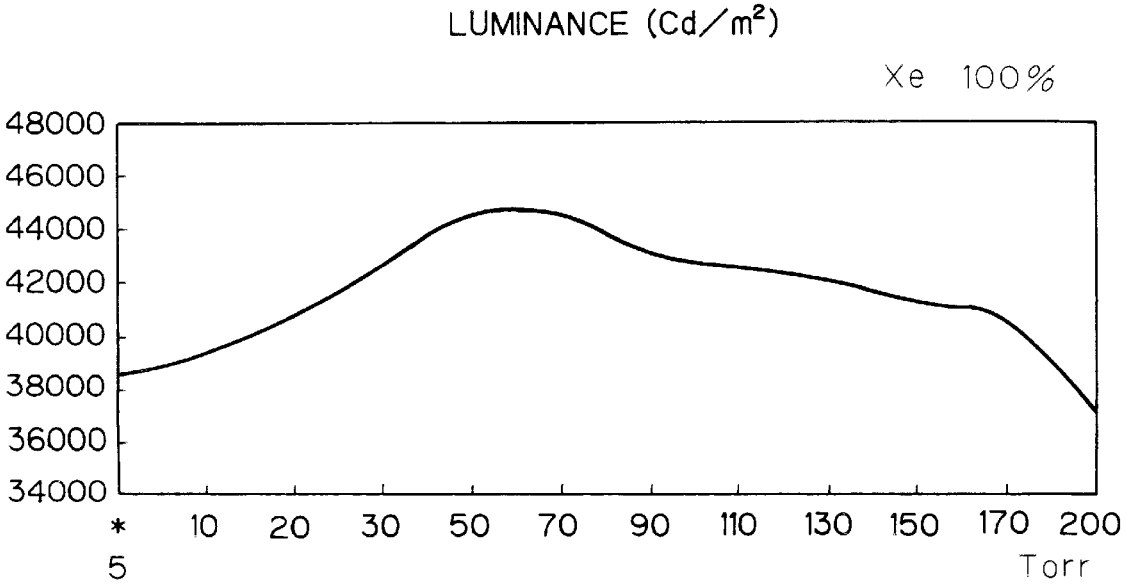
Figure 6A:
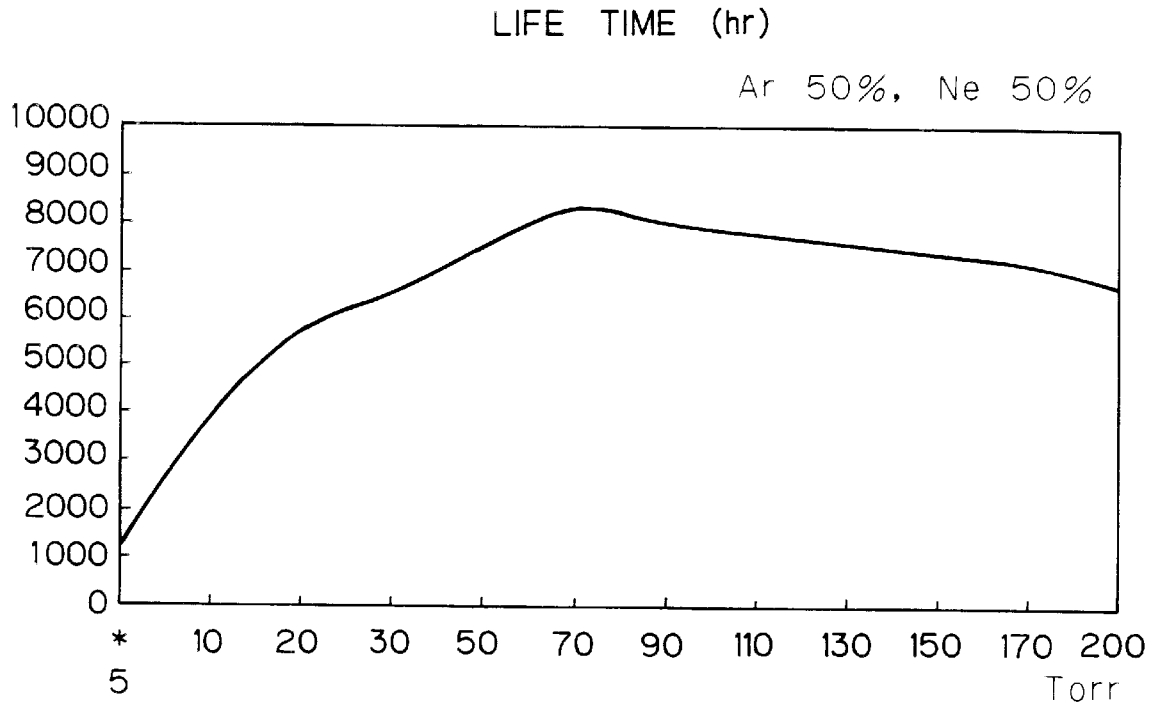
Figure 6B:
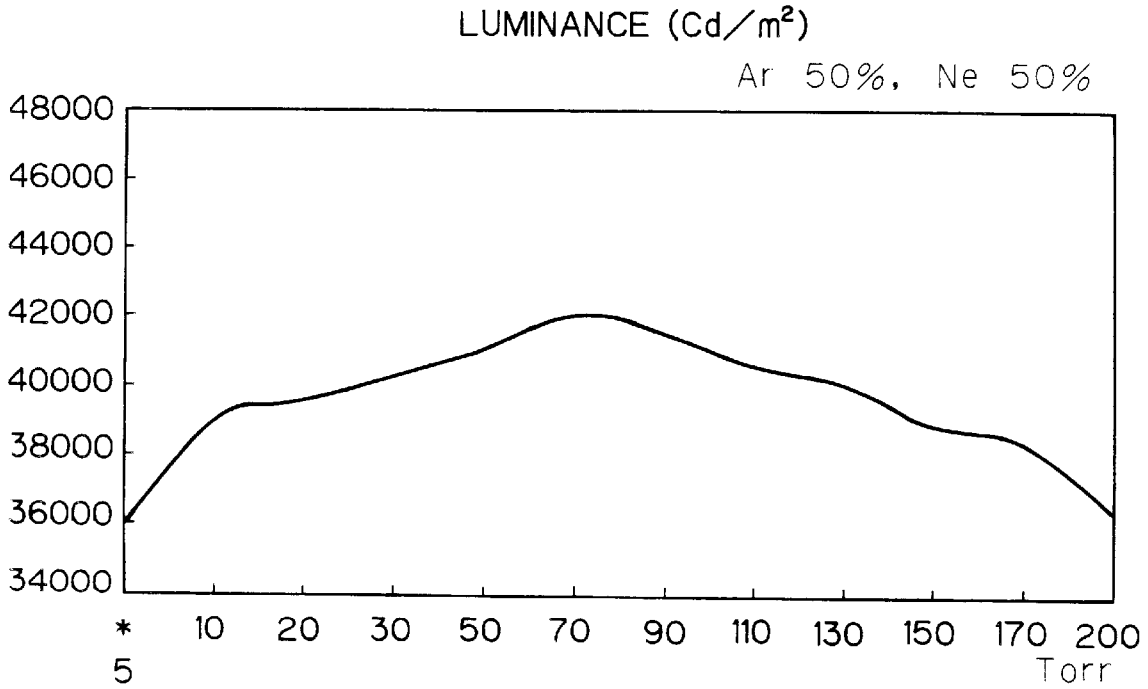
Figure 7A:
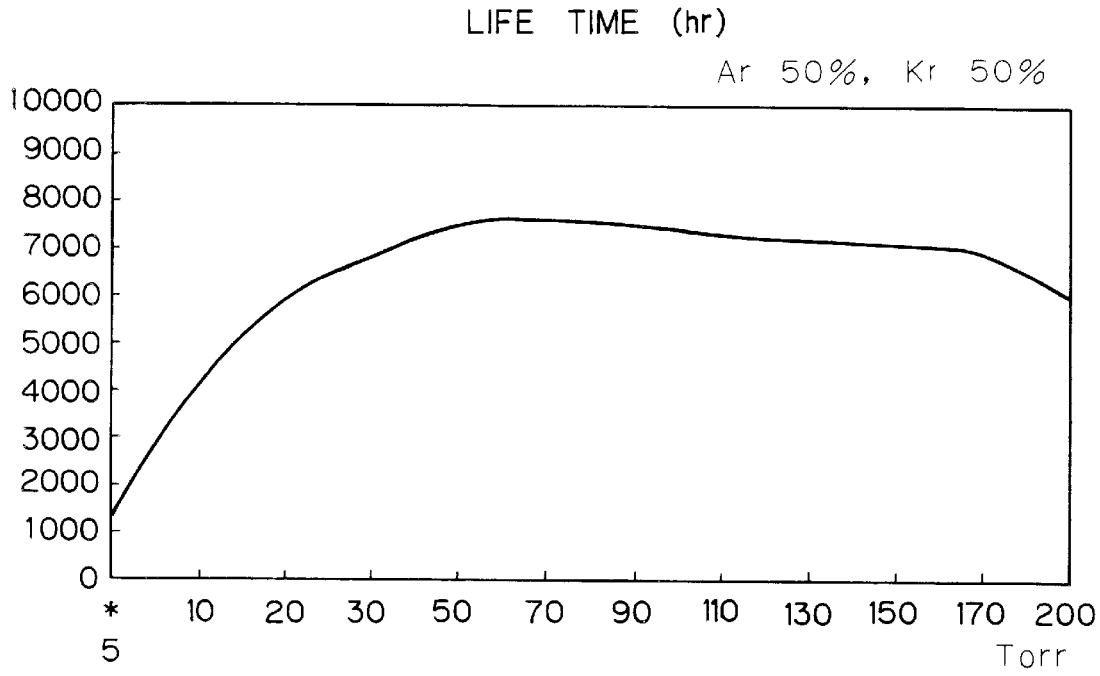
Figure 7B:
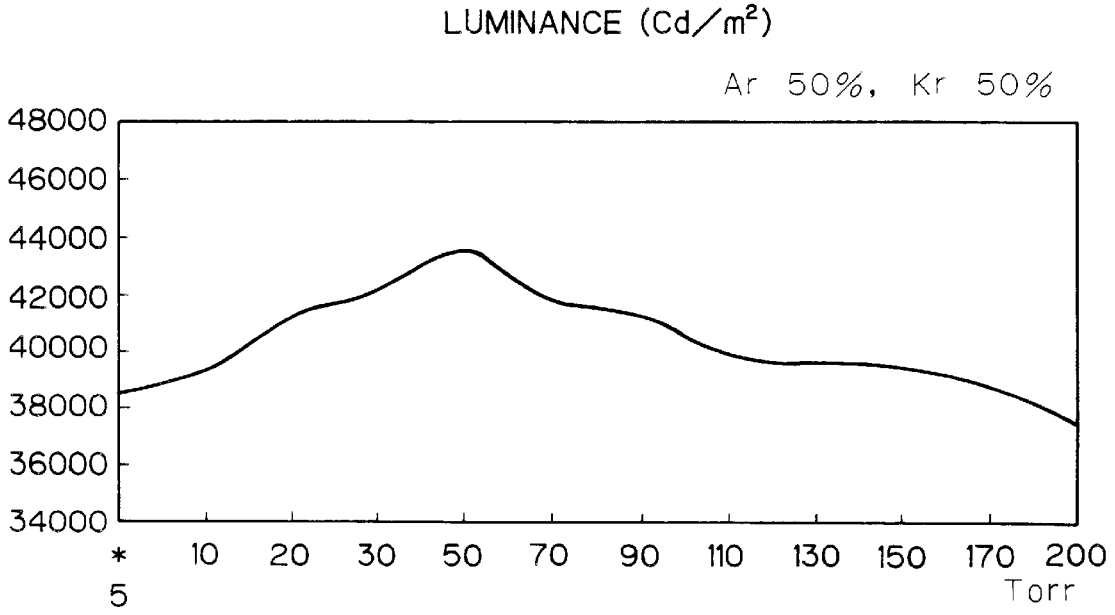
Figure 8A:
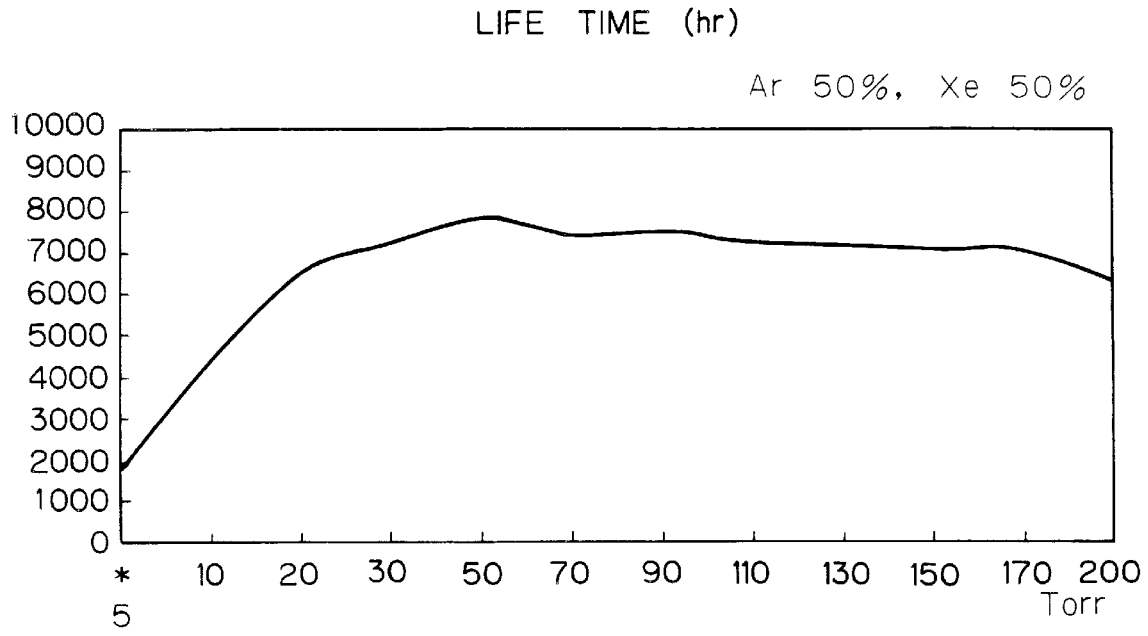
Figure 8B:
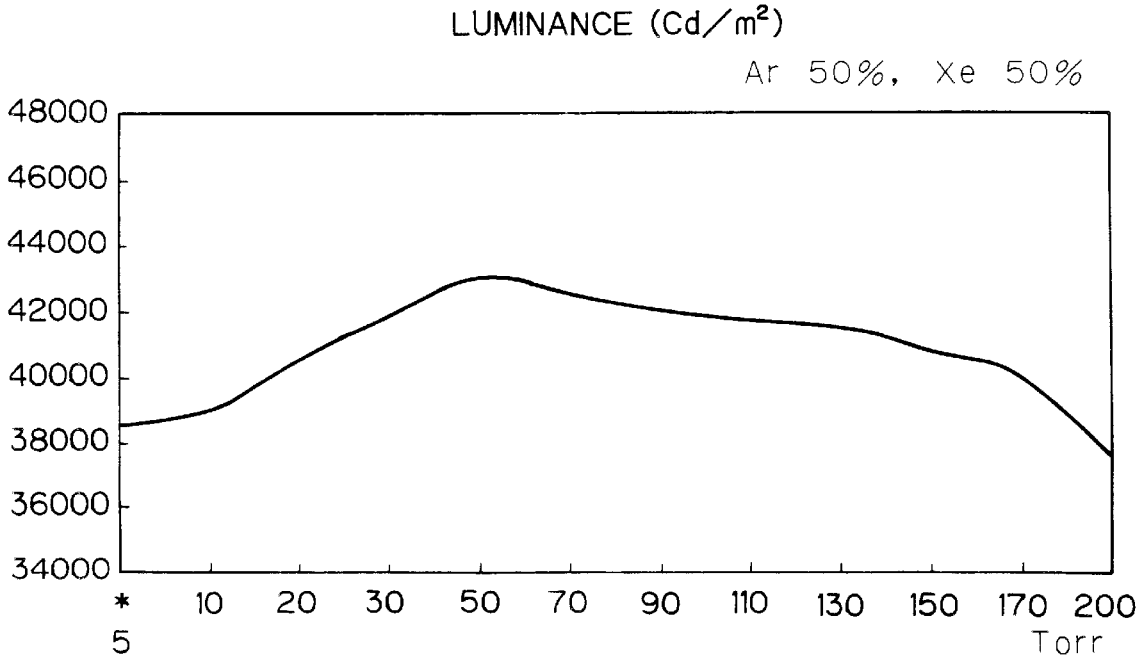
Figure 9A:
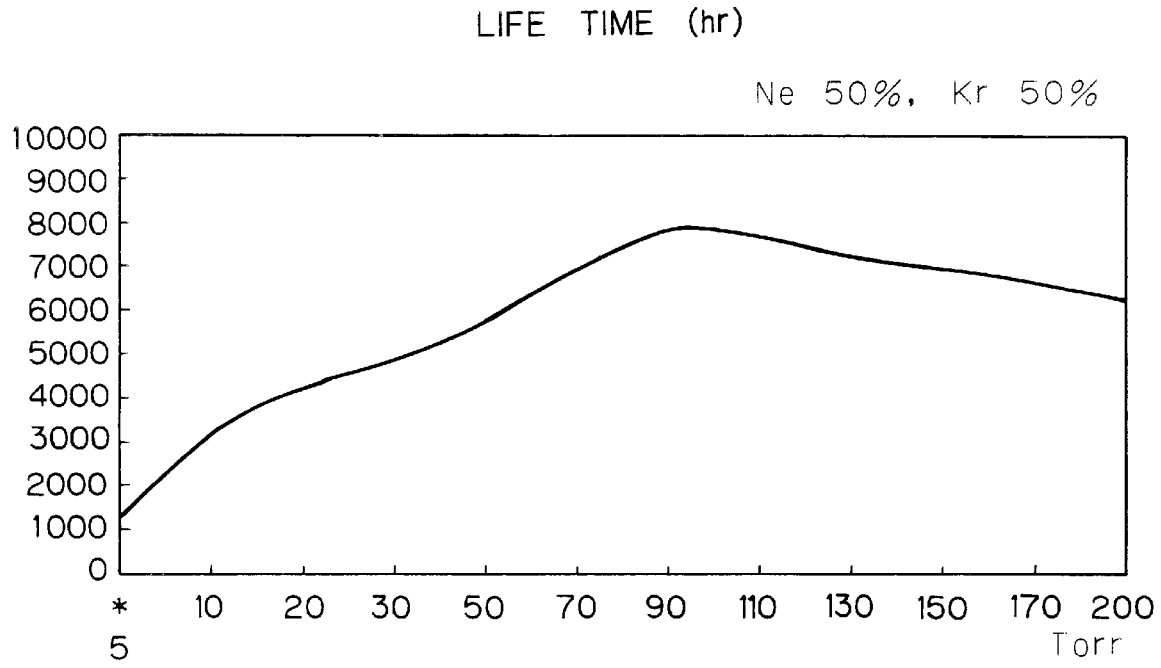
Figure 9B:
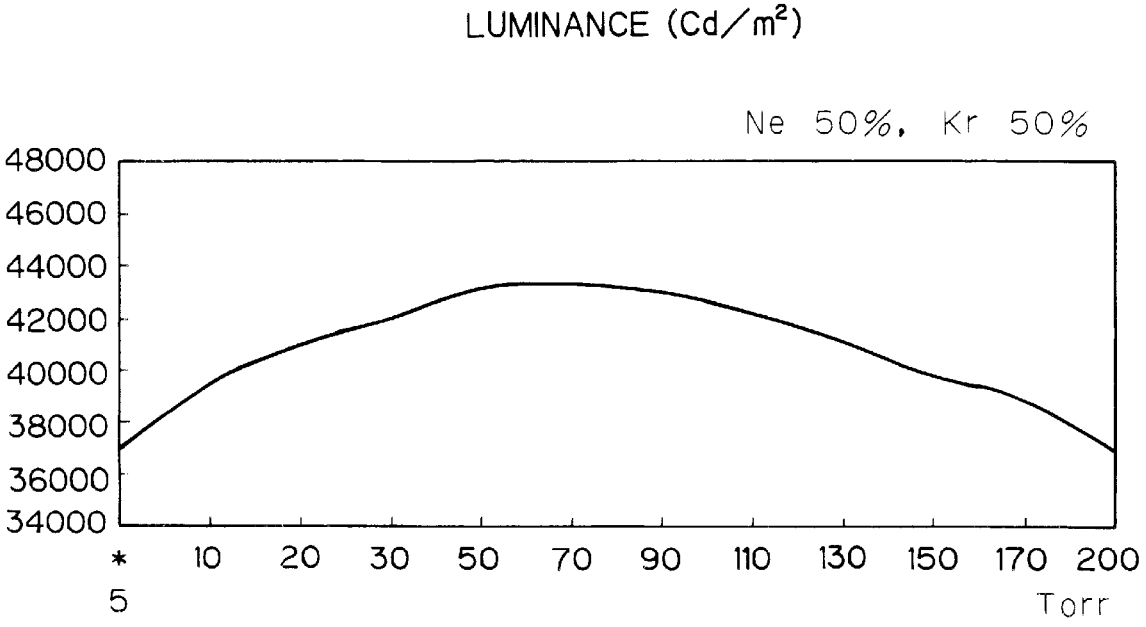
Figure 10A:
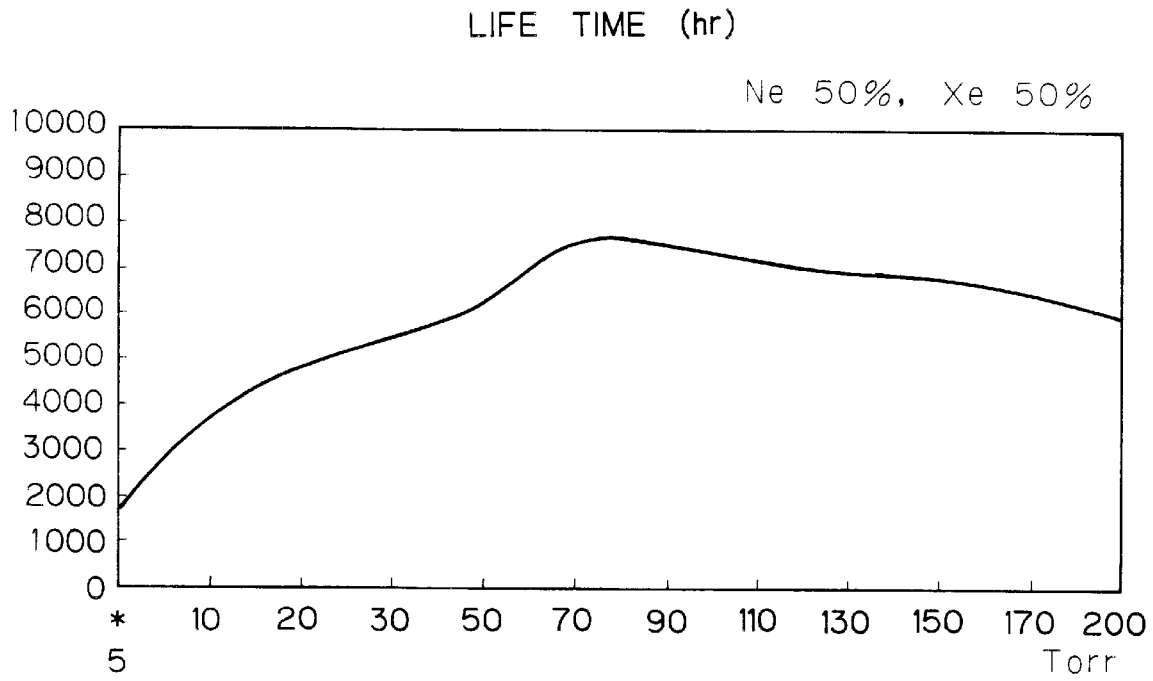
Figure 10B:
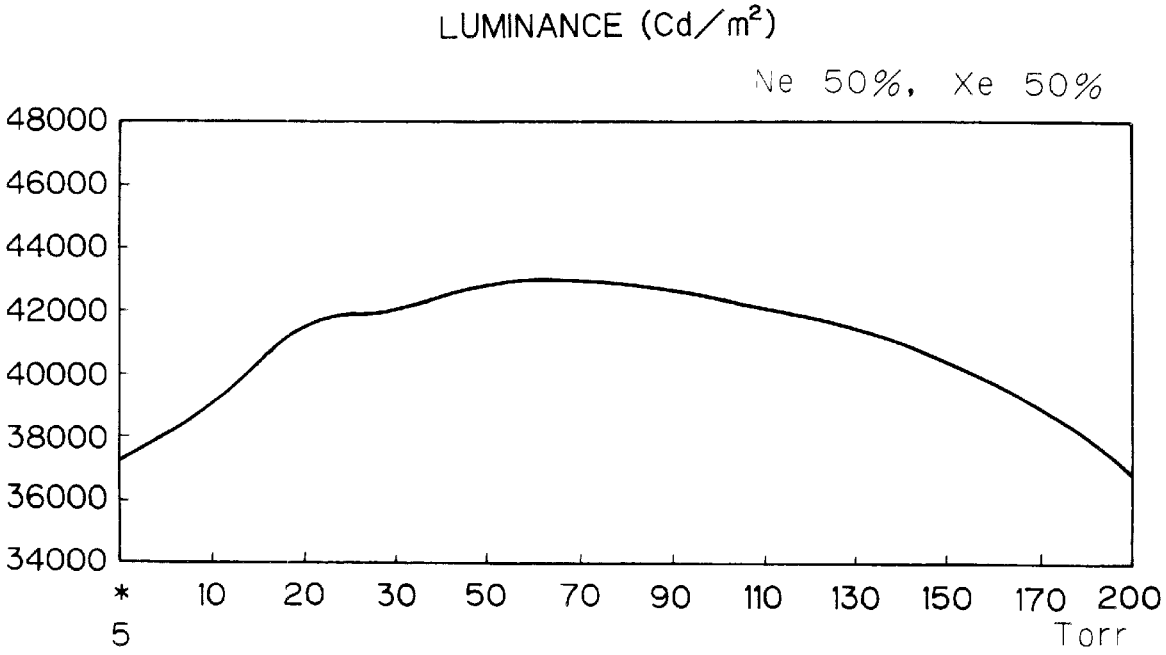
Figure 11A:
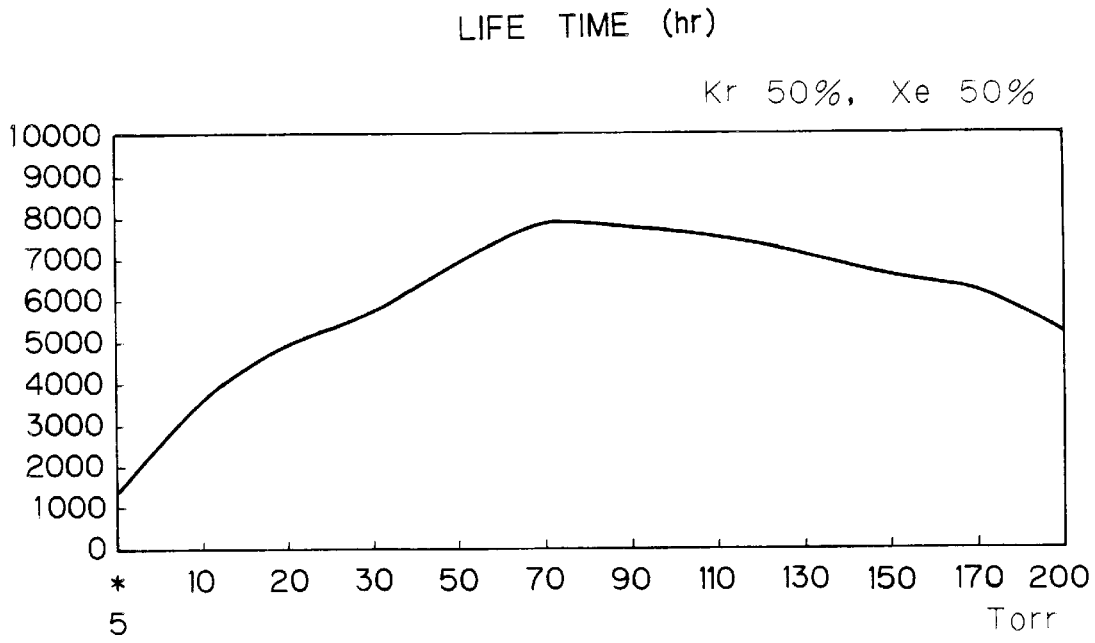
Figure 11B:
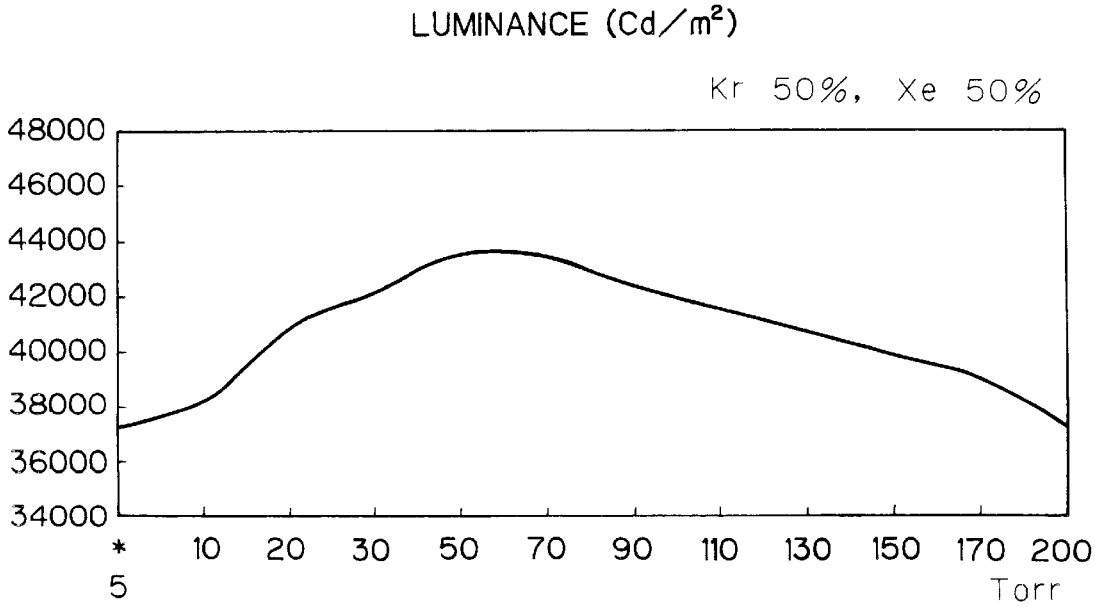
Figure 12A:
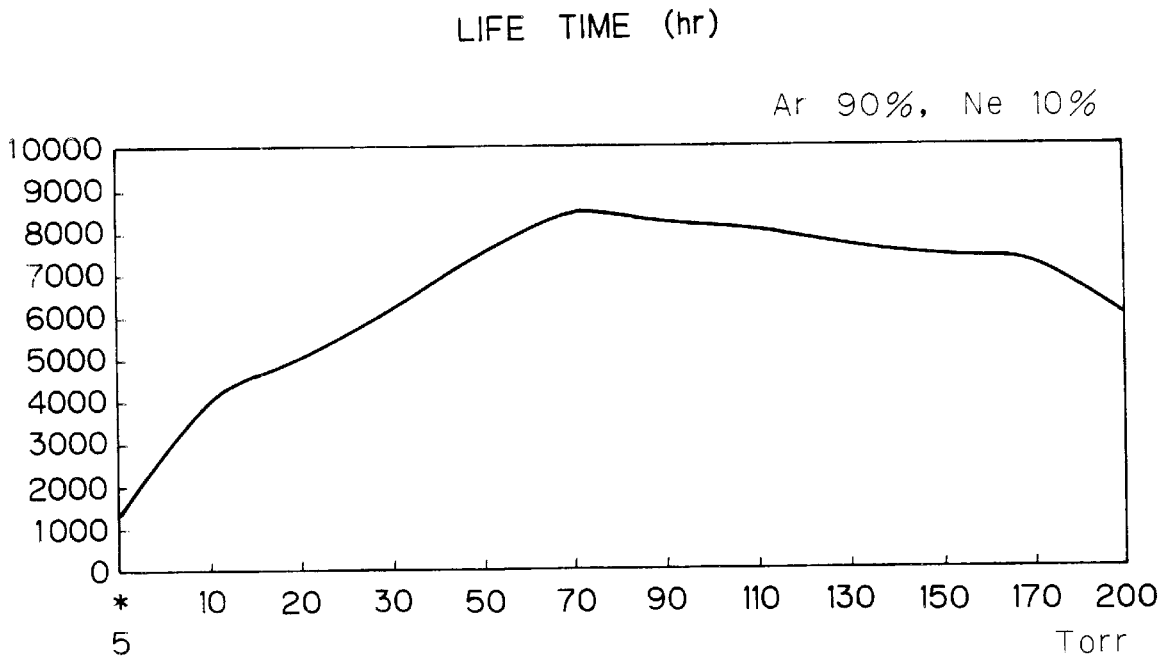
Figure 12B:
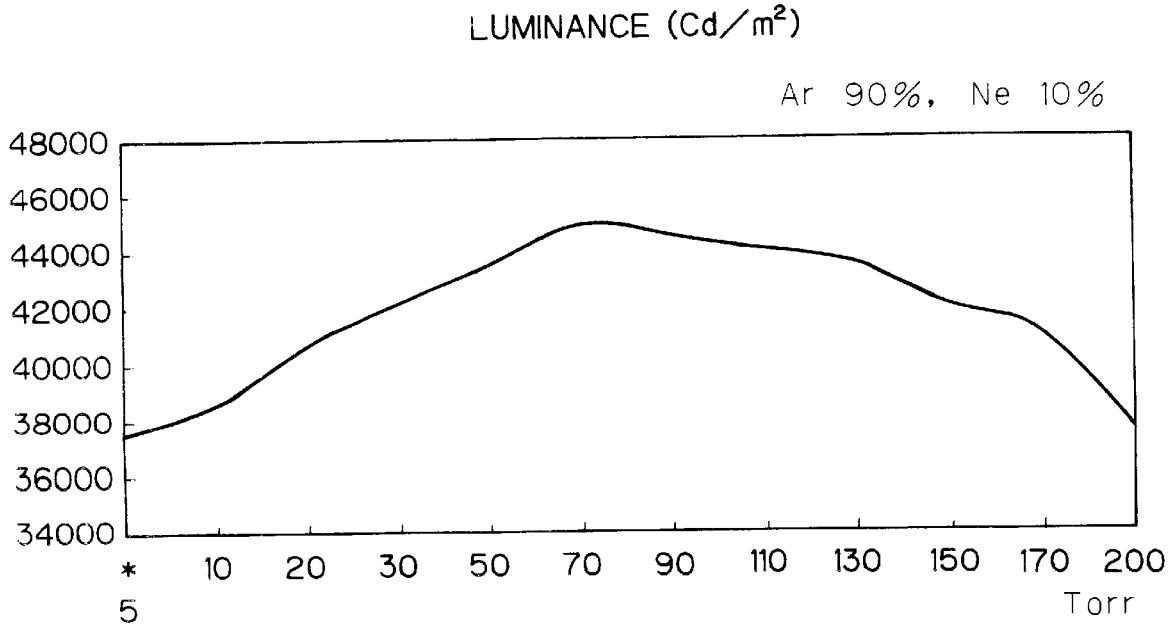
Figure 13A:
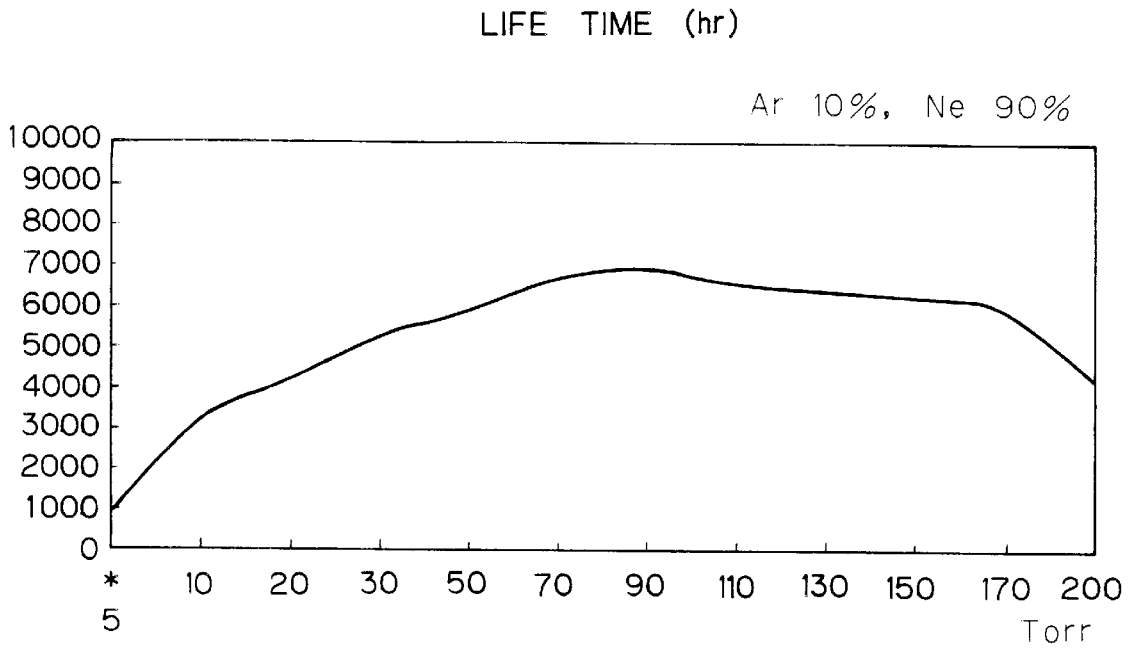
Figure 13B:
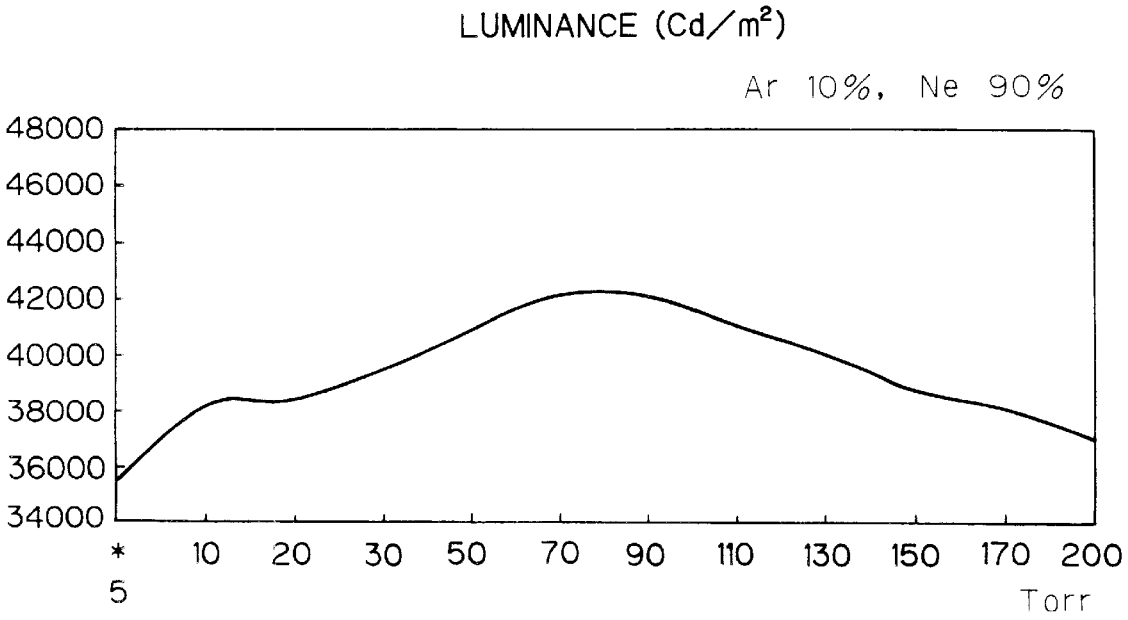
Figure 14A:
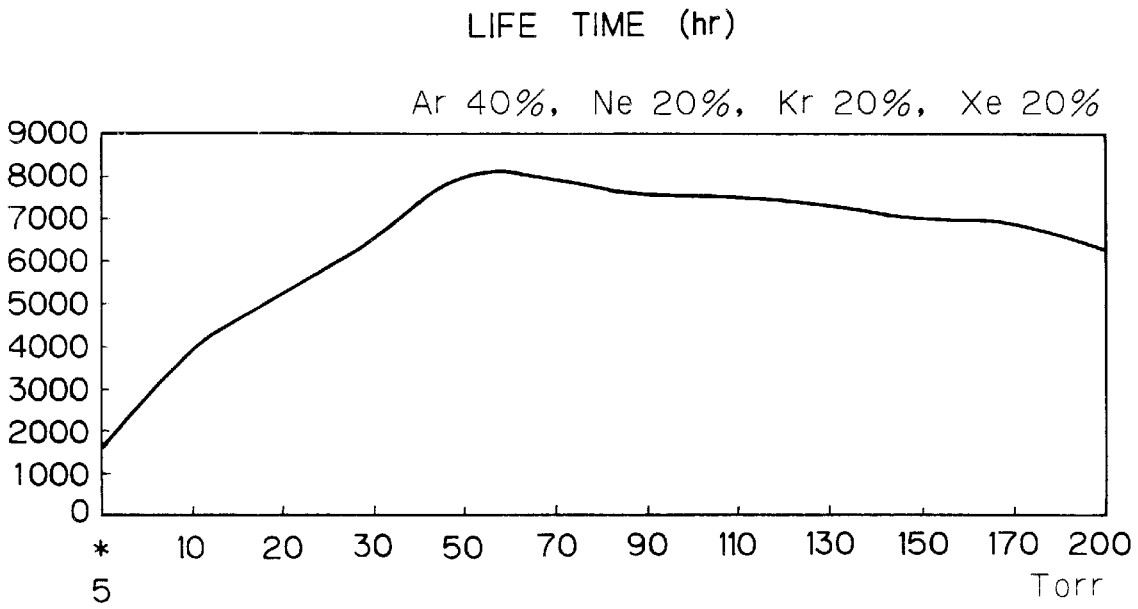
Figure 14B:
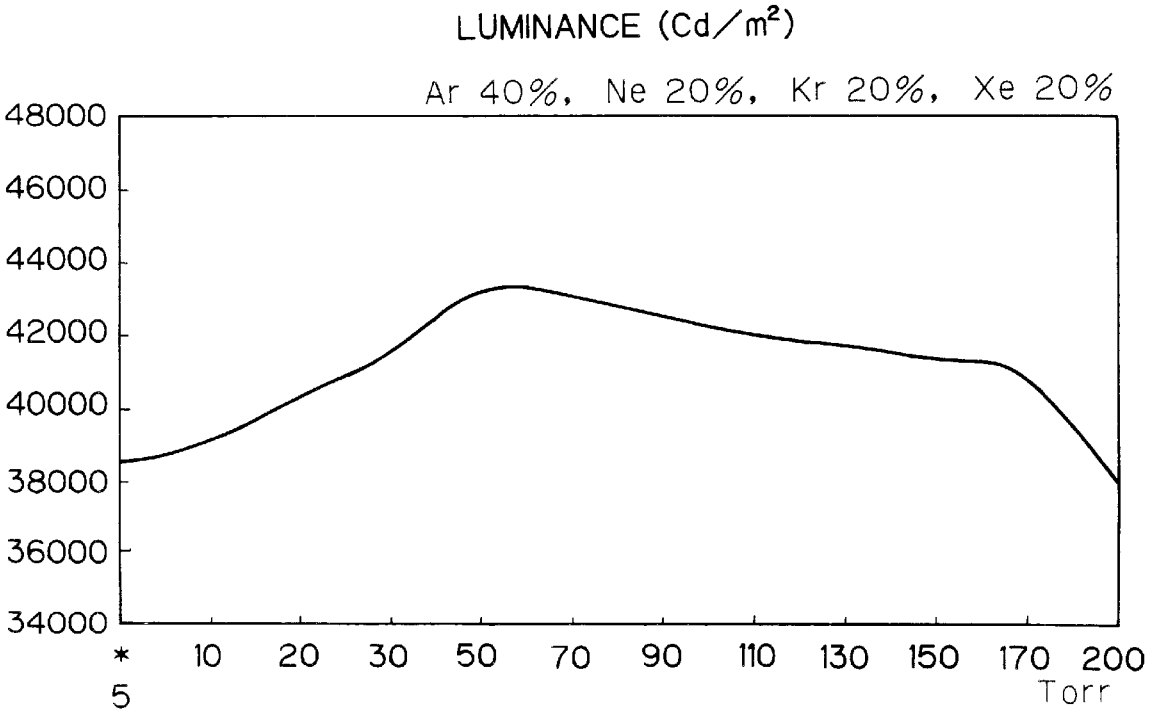
Figure 15:
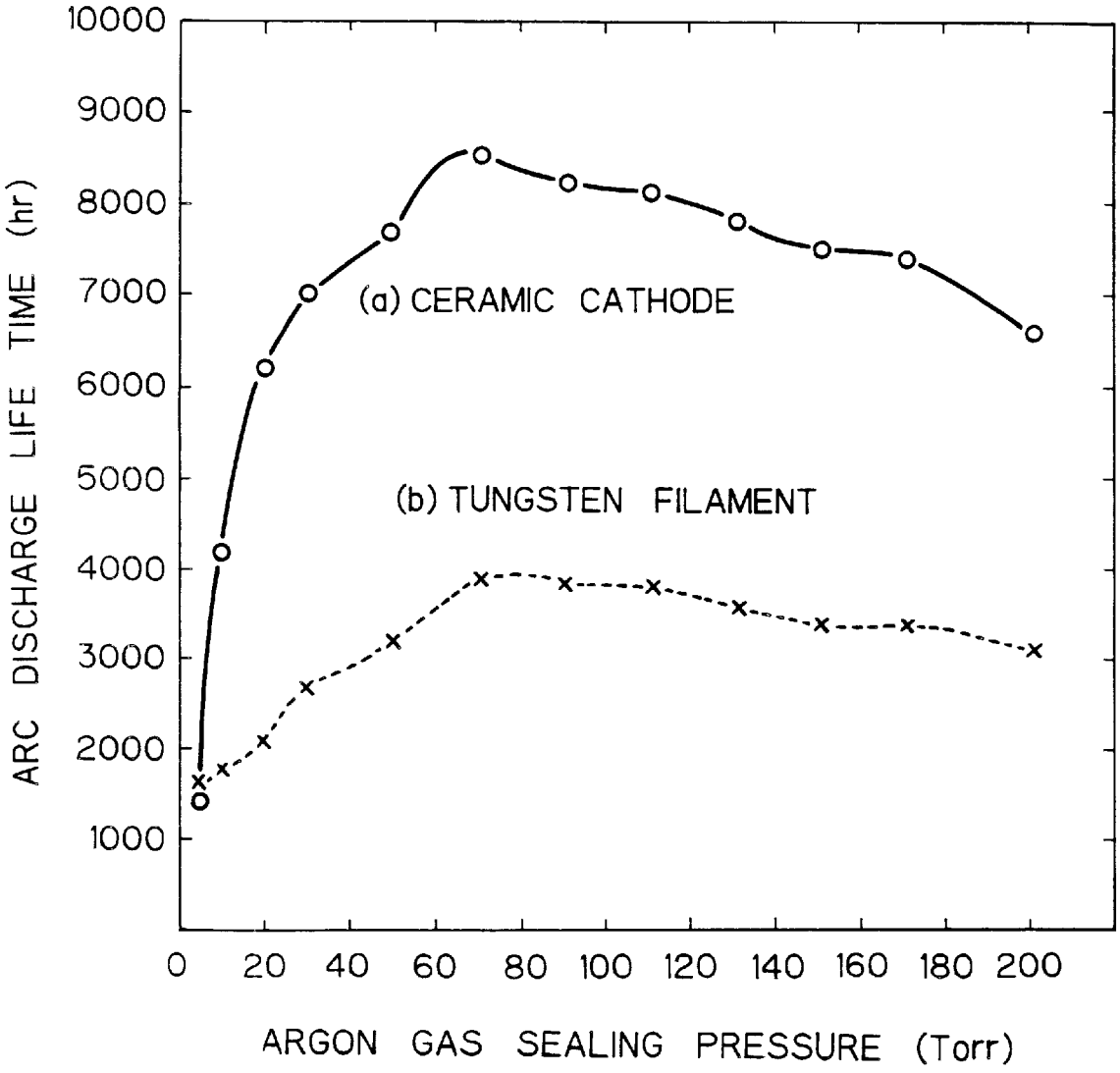
FIG. 15 shows the relationship between sealing pressure (Torr) of Ar gas on the horizontal axis in the range of 5 Torr and 200 Torr, and arc discharge lifetime (curve (a)). The dotted curve (b) in FIG. 15 shows the relationship when a tungsten (W) filament is used as a cathode in a fluorescent discharge lamp.
Figure 16:
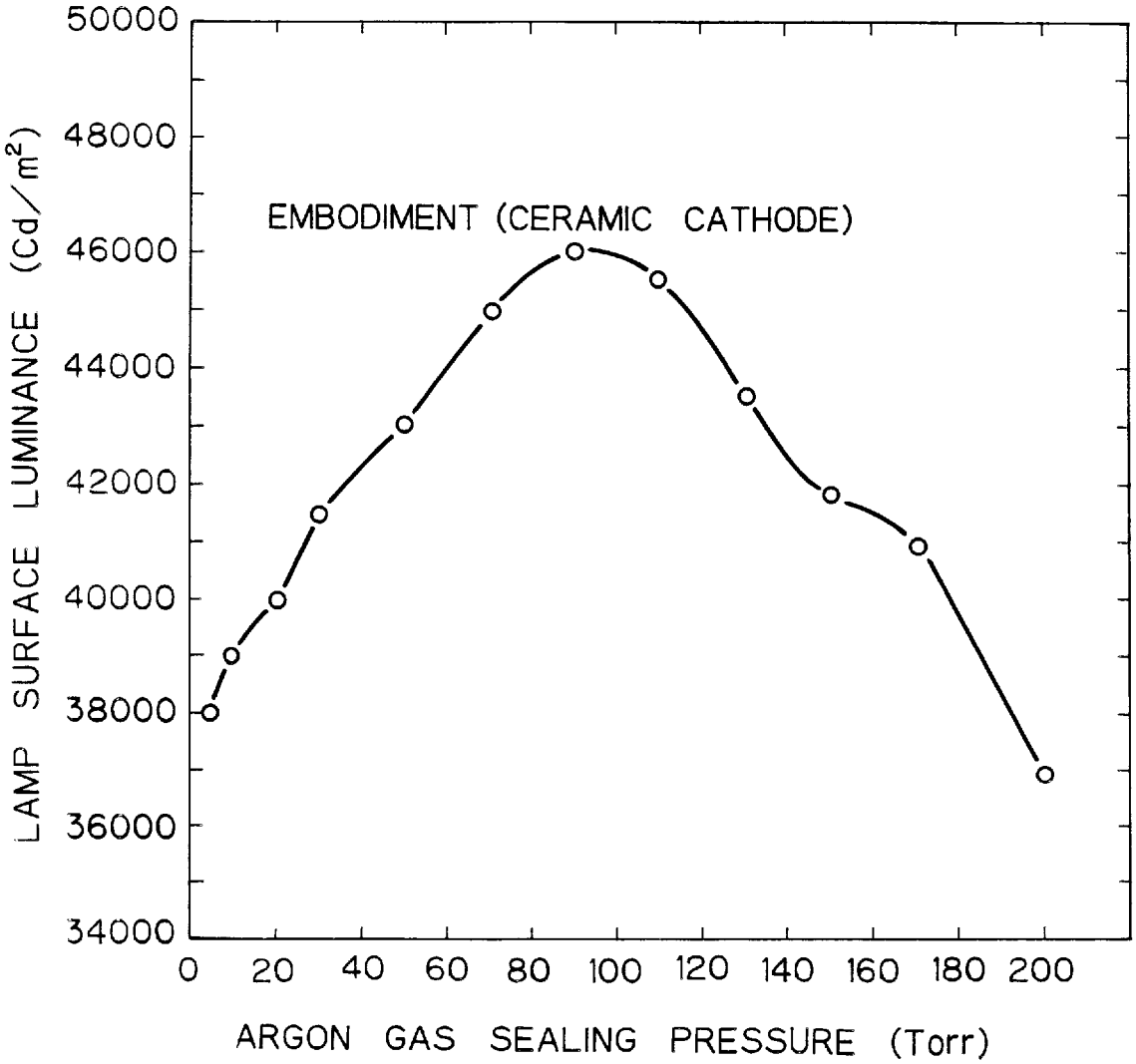
FIG. 16 shows the relationship between sealing pressure (Torr) of Ar gas on the horizontal axis, and surface luminance.

(11) As a result of the sintering operation, a ceramic cathode 1 having an aggregate type porous structure 3 of $Ba(Zr, Ta)O_3$ in a cylindrical bottomed electrode housing having a bottom is obtained as shown in FIG. 1E.

If the sintering temperature is lower than 1400° C.,no conductive surface or semiconductive surface of one of a carbide, nitride, and oxide of Ta and Nb is produced. If the sintering temperature is higher than 2000° C., the electron emission material cannot keep granulated grain as shown in FIG. 1E.

Therefore, it is preferable that the sintering temperature is in the range between 1400° C. and 200° C.

The aggregate type porous structure in the above explanation includes a porous structure in which solid grains contact one another at contact points through a sintering and solidification process, like sintered metal or refractory insulating brick.

A conductive layer and semiconductor layer may be coated through a vacuum evaporation process on the surface of the sintered aggregate type porous structure.

With the above process, a conductive layer or semiconductor layer made of at least one of carbide, nitride, oxide of Ta,Nb is provided on the surface of the aggregate type porous structure of FIG. 1E through a sintering operation in a reducing atmosphere, or vacuum evaporation.

The phase produced on the surface of electron emission material comprises at least one of a carbide, nitride, and oxide of Ta,and Nb, alternatively, it may be a solid solution of these.

According to the present invention, an electron emission material is used comprising a granulated grain with a diameter in the range between 20 $\mu$m and 300 $\mu$m and with a surface coated with at least one of carbide and nitride of Ta and Nb, the grain comprising a first component of at least one of Ba, Sr and Ca present in a concentration of mole ratio x in the form of BaO, SrO and, CaO, respectively, a second component of at least one of Zr and Ti preset in a concentration mole ratio y in the form of $ZrO_2$ and $TiO_2$ respectively, and a third component of at least one of Ta and NB present in a concentration of mole ratio z in the form of (½)($Ta_2O_5$) and (½)($Nb_2O_5$), wherein $0.8 \leqq = x/(y+z) \leqq = 2.0$, $0.05 \leqq = y \leqq = 0.6$, and $0.4 \leqq = z \leqq = 0.95$ are satisfied.

(Experiment Concerning Composition of a Ceramic Cathode)

The starting materials are $BaCO_3$, $SrCO_3$, $CaCO_3$, $ZrO_2$, $TiO_2$, $Ta_2O_5$, and $Nb_2O_5$. These starting materials are measured by weight for the predetermined ratios, and wet-mixed through ball milling for 20 hours. Then, the product is dried at 80–130° C., and formed with a forming pressure of approximately 100 MPa. Next, it is calcined at 800–100° C. for 2 hours in an air atmosphere. The resultant grain is finely ground through ball-milling for 20 hours, dried at 80–130° C., then, entered into water solution including polyvinyl alcohol so that granulated grain is produced by using a mortar and a pestle. The granulated grain thus obtained is classified by using a sieve so that grain of approximate average diameter of 90 $\mu$m is obtained. Then, a cylindrical bottomed ceramic housing made of Ba—Ta—Zr—O group is filled with the granulated grain thus obtained with no pressure, and carbon powder is added to the housing. Finally, the housing including grain is sintered in a flow of nitrogen gas, and a ceramic cathode having a composition as shown in Tables 14 through 17 is obtained.

A fluorescent lamp is produced by using a ceramic 5 cathode thus produced, and a continuous lighting test is carried out for a lamp.

The evaluation of the continuous light test of a fluorescent lamp is as follows. When a fluorescent lamp is used as a light source of back light in a liquid crystal display device, it is preferable that lamp wall temperature is lower than 90° C., whichever it is directly under type or edge light type. When the temperature exceeds 90° C., the components for back light including a reflector, a distributor, a light guide are deteriorated quickly, and therefore, that condition is not practical. The wall surface temperature of a fluorescent lamp increases depending upon lighting hours, because lamp voltage and consumed power increase depending upon lighting hours. The time $t_1$ when wall surface temperature reaches 90° C. is measured as criterion of lifetime of a lamp for evaluating a continuous lighting test.

Wall surface temperature of a lamp is measured as follows. We first measured temperature distribution on a lamp by using an infrared radiation type thermography, and found that the temperature is the highest around an end of a tube of a lamp. Therefore, a K thermocouple is attached directly on portion 12 (FIG. 1C) close to an end of a lamp, and measured wall surface temperature of a lamp in a room kept at temperature 25° C.

The conditions of the continuous light test are as follows.

Length of a lamp: 100 mm

Outer diameter of a lamp: 3 mm ø

Lamp current: 15 mA

Inverter: 30 kHz (no preheating circuit)

TABLE 14

| Sample | Sample composition (mole ratio) | | | $t_1$ | |
|---|---|---|---|---|---|
| No. | BaO | $ZrO_2$ | (1/2)$Ta_2O_5$ | (hour) | Comments |
| *1 | .05 | .05 | .05 | 900 | lack emission material |
| *2 | .07 | 0.05 | 0.95 | 1000 | lack emission material |

TABLE 14-continued

| Sample | Sample composition (mole ratio) | | | $t_1$ | |
|---|---|---|---|---|---|
| No. | BaO | $ZrO_2$ | (1/2)$Ta_2O_5$ | (hour) | Comments |
| *3 | .07 | 0.1 | 0.9 | 1200 | lack emission material |
| *4 | 0.7 | 0.2 | 0.8 | 1400 | lack emission material |
| *5 | 0.7 | 0.4 | 0.6 | 1200 | lack emission material |
| *6 | 0.7 | 0.6 | 0.4 | 1200 | lack emission material |
| 7 | 0.8 | 0.025 | 0.975 | 700 | grain destroyed |
| 8 | 0.8 | 0.05 | 0.095 | 2900 | |
| 9 | 0.8 | 0.1 | 0.9 | 3100 | |
| 10 | 0.8 | 0.4 | 0.6 | 2900 | |
| 11 | 0.8 | 0.6 | 0.4 | 2700 | |
| *12 | 0.8 | 0.8 | 0.2 | 900 | No carbide, no nitrate |
| 13 | 0.9 | 0.1 | 0.9 | 4100 | |
| 14 | 0.9 | 0.4 | 0.6 | 3900 | |
| *15 | 1 | 0.025 | 0.975 | 500 | grain destroyed |
| 16 | 1 | 0.05 | 0.95 | 3200 | |
| 17 | 1 | 0.1 | 0.9 | 4300 | |
| 18 | 1 | 0.2 | 0.8 | 5000 | |
| 19 | 1 | 0.3 | 0.7 | 4500 | |
| 20 | 1 | 0.4 | 0.6 | 4200 | |
| *21 | 1 | 0.7 | 0.3 | 1500 | no carbide, no nitride |
| *22 | 1 | 0.8 | 0.2 | 1200 | no carbide, no nitride |
| *23 | 1 | 0.95 | 0.05 | 300 | no carbide, no nitride |
| 24 | 1.2 | 0.1 | 0.9 | 4100 | |
| 25 | 1.2 | 0.2 | 0.8 | 4400 | |
| *26 | 1.2 | 0.625 | 0.375 | 1500 | no carbide, no nitrade |
| *27 | 1.4 | 0.025 | 0.975 | 500 | grain destroyed |
| 28 | 1.4 | 0.1 | 0.9 | 3900 | |
| 29 | 1.4 | 0.2 | 0.8 | 4800 | |
| 30 | 1.4 | 0.3 | 0.7 | 4400 | |
| 31 | 1.5 | 0.1 | 0.9 | 4000 | |
| 32 | 1.5 | 0.4 | 0.6 | 3800 | |
| *33 | 1.6 | 0.025 | 0.975 | 600 | grain destroyed |
| 34 | 1.6 | 0.05 | 0.95 | 2700 | |
| 35 | 1.6 | 0.1 | 0.9 | 3500 | |
| 36 | 1.6 | 0.4 | 0.6 | 3600 | |
| 37 | 1.6 | 0.6 | 0.4 | 2900 | |
| 38 | 1.7 | 0.5 | 0.5 | 2600 | |
| *39 | 1.7 | 0.9 | 0.1 | 300 | no carbide, no nitride |
| *40 | 2 | 0.025 | 0.975 | 300 | grain destroyed |
| 41 | 2 | 0.05 | 0.95 | 2100 | |
| 42 | 2 | 0.2 | 0.8 | 2600 | |
| 43 | 2 | 0.4 | 0.6 | 2500 | |
| 44 | 2 | 0.6 | 0.4 | 2100 | |
| *45 | 2.5 | 0.1 | 0.9 | 2400 | tube wall blackened |
| *46 | 2.5 | 0.4 | 0.6 | 300 | tube wall blackened |

*sample is out of invention $t_1$ = time when tube wall temperature reaches 90° C. in Continuous lighting test When tube wall is blackened violently, Luminance decreases, and a lamp is not practical

TABLE 15

| Sample No. | Sample composition (mole ratio) BaO | SrO | CaO | $ZrO_2$ | (1/2) | $(Ta_2O_5)$ | $t_1$ (hour) | Comment |
|---|---|---|---|---|---|---|---|---|
| *47 | 0 | 0.7 | | 0 | 0.1 | 0.9 | 1300 | lack emission |
| *43 | 0 | 0 | | 0.7 | 0.1 | 0.9 | 1100 | lack emission |
| *49 | 0.233 | 0.233 | | 0.233 | 0.1 | 0.9 | 1000 | lack emission |
| 50 | 0 | 0.5 | | 0 | 0.05 | 0.95 | 2400 | |
| 51 | 0 | 0.8 | | 0 | 0.6 | 0.4 | 2500 | |
| 52 | 0 | 0 | | 0.8 | 0.05 | 0.95 | 2400 | |
| 53 | 0 | 0 | | 0.8 | 0.6 | 0.4 | 2400 | |
| 54 | 0.267 | 0.267 | | 0.267 | 0.05 | 0.95 | 3100 | |
| 55 | 0.267 | 0.267 | | 0.267 | 0.6 | 0.4 | 3000 | |
| 56 | 0 | 0.9 | | 0 | 0.1 | 0.9 | 4100 | |
| 57 | 0 | 0.9 | | 0 | 0.4 | 0.6 | 3900 | |
| 58 | 0 | 0 | | 0.9 | 0.1 | 0.9 | 3700 | |
| 59 | 0 | 0 | | 0.9 | 0.4 | 0.6 | 3600 | |
| 60 | 0.3 | 0.3 | | 0.3 | 0.1 | 0.9 | 3800 | |
| 61 | 0.3 | 0.3 | | 0.3 | 0.4 | 0.6 | 4200 | |
| 62 | 0 | 1 | | 0 | 0.2 | 0.8 | 5000 | |
| *63 | 0 | 1 | | 0 | 0.95 | 0.05 | 200 | no carbide, no nitrate |
| 64 | 0 | 0 | | 1 | 0.2 | 0.8 | 5000 | |
| *65 | 0 | 0 | | 1 | 0.95 | 0.05 | 300 | no carbide, no nitrate |
| 66 | 0.333 | 0.333 | | 0.333 | 0.2 | 0.8 | 5000 | |
| *67 | 0.333 | 0.333 | | 0.333 | 0.95 | 0.05 | 20 | no carbide, no nitrate |
| 68 | 0 | 1.5 | | 0 | 0.1 | 0.9 | 4100 | |
| 69 | 0 | 1.5 | | 0 | 0.4 | 0.6 | 3700 | |
| 70 | 0 | 0 | | 1.5 | 0.1 | 0.9 | 3500 | |
| 71 | 0 | 0 | | 1.5 | 0.4 | 0.6 | 3700 | |
| 72 | 0.5 | 0.5 | | 0.5 | 0.1 | 0.9 | 4500 | |
| 73 | 0.5 | 0.5 | | 0.5 | 0.4 | 0.6 | 3700 | |
| *74 | 0 | 1.6 | | 0 | 0.025 | 0.975 | 500 | grain destroyed |
| 75 | 0 | 1.6 | | 0 | 0.05 | 0.95 | 2600 | |
| 76 | 0 | 1.6 | | 0 | .6 | 0.4 | 2600 | |
| *77 | 0 | 0 | | 1.6 | 0.025 | 0.975 | 500 | grain destroyed |
| 78 | 0 | 0 | | 1.6 | 0.05 | 0.95 | 2700 | |
| 79 | 0 | .6 | | 0.6 | 0.4 | 2500 | | |
| *80 | 0.533 | 0.533 | | 0.533 | 0.025 | 0.975 | 800 | grain destroyed |
| 82 | 0.533 | 0.533 | | 0.533 | 0.05 | 0.95 | 2500 | |
| 82 | 0.533 | 0.533 | | 0.533 | 0.6 | 0.4 | 3200 | |
| *83 | 0 | 2.5 | | 0 | 0.1 | 0.9 | 2200 | tube wall blackened |
| *84 | 0 | 0 | | 2.5 | 0.1 | 0.9 | 2200 | tube wall blackened |
| *85 | 0.833 | 0.833 | | 0.833 | 0.1 | 0.9 | 2300 | tube wall blackened |

*sample is out of invention $t_1$ = time when tube wall temperature reaches 90° C. in continuous lighting test When tube wall is blackened violently, luminance decreases, and a lamp is not practical

TABLE 16

| Sample No. | Sample composition (mole ratio) BaO | $ZrO_2$ | $TiO_2$ | $(1/2)(Ta_2O_5)$ | $t_1$ (hour) | Comment |
|---|---|---|---|---|---|---|
| *86 | 0.7 | 0.05 | 0.05 | 0.9 | 1500 | lack emission |
| 87 | 0.8 | 0.025 | 0.025 | 0.95 | 2300 | |
| 88 | 0.8 | 0.3 | 0.3 | 0.4 | 2300 | |
| 89 | 0.9 | 0.05 | 0.05 | 0.9 | 3700 | |
| 90 | 0.9 | 0.2 | 0.2 | 0.6 | 3800 | |
| 91 | 1 | 0.1 | 0.1 | 0.8 | 5000 | |
| *92 | 1 | 0.475 | 0.475 | 0.05 | 50 | no carbide, no nitrate |
| 93 | 1.5 | 0.05 | 0.05 | 0.9 | 4000 | |
| 94 | 1.5 | 0.2 | 0.2 | 0.6 | 4200 | |
| *95 | 1.6 | 0.013 | 0.013 | 0.974 | 120 | grain destroyed |
| 96 | 1.6 | 0.025 | 0.025 | 0.95 | 2200 | |
| 97 | 1.6 | 0.3 | 0.3 | 0.4 | 2200 | |
| *98 | 2.5 | 0.05 | 0.05 | 0.9 | 1800 | tube wall blackened |

TABLE 17

| Sample | Sample composition (mole ratio) | | | | $t_1$ | |
|---|---|---|---|---|---|---|
| No. | BaO | $ZrO_2$ | $(1/2)(Ta_2O_5)$ | $(1/2)(Nb_2O_5)$ | (hour) | Comment |
| *99 | 0.7 | 0.1 | 0 | 0.9 | 1300 | lack emission |
| *100 | 0.7 | 0.1 | 0.45 | 0.45 | 1200 | lack emission |
| 101 | 0.8 | 0.05 | 0 | 0.95 | 2300 | |
| 102 | 0.8 | 0.6 | 0 | 0.4 | 2400 | |
| 103 | 0.8 | 0.05 | 0.425 | 0.425 | 2700 | |
| 104 | 0.8 | 0.6 | 0.2 | 0.2 | 2500 | |
| 105 | 0.9 | 0.1 | 0 | 0.9 | 3700 | |
| 106 | 0.9 | 0.4 | 0 | 0.6 | 3500 | |
| 107 | 0.9 | 0.1 | 0.45 | 0.45 | 4000 | |
| 108 | 0.9 | 0.4 | 0.3 | 0.3 | 4200 | |
| 109 | 1 | 0.2 | 0 | 0.8 | 4900 | |
| 110 | 1 | 0.2 | 0.4 | 0.4 | 5000 | |
| *111 | 1 | 0.95 | 0 | 0.05 | 120 | no carbide, no nitrate |
| *112 | 1 | 0.95 | 0.025 | 0.025 | 100 | no carbide, no nitrate |
| 113 | 1.5 | 0.1 | 0 | 0.9 | 3500 | |
| 114 | 1.5 | 0.1 | 0.45 | 0.45 | 4300 | |
| 115 | 1.5 | 0.4 | 0 | 0.6 | 3600 | |
| 116 | 1.5 | 0.4 | 0.3 | 0.3 | 4000 | |
| *117 | 1.6 | 0.025 | 0 | 0.975 | 400 | grain destroyed |
| *118 | 1.6 | 0.025 | 0.478 | 0.4875 | 700 | grain destroyed |
| 119 | 1.6 | 0.05 | 0 | 0.95 | 2300 | |
| 120 | 1.6 | 0.05 | 0.425 | 0.425 | 2900 | |
| 121 | 1.6 | 0.6 | 0 | 0.4 | 2400 | |
| 122 | 1.6 | 0.6 | 0.2 | 0.2 | 2800 | |
| *123 | 2.5 | 0.1 | 0 | 0.9 | 2000 | tube wall blackened |
| *124 | 2.5 | 0.1 | 0.45 | 0.45 | 2000 | tube wall blackened |

$t_1$ = time when tube wall temperature reaches 90° C. in continuous lighting test
When tube wall is blackened violently, luminance decreases, and a lamp is not practical The samples 12, 21, 22, 23, 26, 39, 63, 65, 67, 92, 111 and 112 have the lifetime $t_1$ less than 1500 hours. We inspected the surface of a ceramic cathode of those samples by using a micro area X ray diffraction analyzer and a SEM 5 (Scanning electron Microscope) inspection, and found no phase of a carbide or nitride of Ta or Nb. Therefore, it is presumed that ceramic cathode material deteriorates rapidly by ion sputtering. As the lifetime $t_1$, is short in those samples, they are not suitable for practical use.

The samples 7, 15, 27, 33, 40, 74, 77, 80, 95, 117, and 118 have the lifetime, $t_1$ less than 800 hours. Those samples cannot maintain a granular condition by sintering in reducing atmosphere, and therefore, no heat is stored for forming arc spot. Thus, the discharge is unstable, and those samples have short lifetimes $t_1$ and are not practical.

The samples 1, 2, 3, 4, 5, 6, 47, 48, 49, 86, 99, and 100 have short lifetime, $t_1$, because of shortage of electron emission material BaO, SrO, and/or CaO, and are not practical. Further, the samples 45, 46, 83, 84, 85, 98, 123, and 124 have the disadvantage that a tube wall changes to black, so that surface luminance decreases and light flux decreases. Therefore, those samples are not practical.

As for the samples 8–11, 13, 14, 16–20, 24, 25, 28–32, 34–38, 41–44, 50–62, 64, 66, 68–73, 75, 76, 78, 79, 81, 82, 87–91, 93, 94, 96, 97, 101–110, 113–116, and 119–122, we observed at least one of carbide and nitride of Ta and Nb by observing a surface of a ceramic cathode by using a micro area X ray diffraction analyzer and an SEM inspection. Further, it is observed that cathode material of those 5 samples maintain the granular condition.

Accordingly, the samples 8–11, 13, 14, 16–20, 24, 25, 28–32, 34–38, 41–44, 50–62, 64, 66, 68–73, 75, 76, 78, 79, 81, 82, 87–91, 93, 94, 96, 97, 101–110, 113–116 and 119–122 maintain a granular condition and form one of a carbide and nitride of Ta and Nb on a surface of a cathode produced through sintering in a reducing atmosphere. And, the lifetime $t_1$ is longer than 2100 hours, and the tube wall does not change to black. Thus, those samples are suitable for a ceramic cathode.

(Relations Between Tube Current and Average Grain Diameter)

A fluorescent lamp is produced by using a cathode according to the present invention, and inspected a number of grains which form an arc spot with parameter of tube current and average grain diameter. The result is shown in the Table 18. The sample used for the test is the sample 18 in the Table 14. The number of grains is counted by using a Hyper microscope manufactured by Keyence company.

When the number of grains forming an arc spot is one, that is to say, the size of an arc spot coincides approximately with average grain diameter, the arc spot does not move and is the most stable. The tube current for keeping stable arc discharge is in the range of 5 mA–500 mA. It is found in the Table 18 that when average grain diameter is in the range between 20 $\mu$m and 300 $\mu$m, a stable arc spot is formed, and discharge is kept for a long time. When average grain diameter is less than 20 $\mu$m with the tube current described, an arc spot moves quickly and discharge is unstable, and when average grain diameter is larger than 300 $\mu$m, the heat for hot electron emission obtained is insufficient, and it tends to become glow discharge. In Table 18, unstable discharge is defined so that an arc spot moves within five minutes, and stable discharge is defined so that an arc spot does not move for more than 10 hours, and glow discharge is defined so that no arc spot is formed but a whole cathode discharges.

TABLE 18

| | | Tube current (mA) | | | | | | |
|---|---|---|---|---|---|---|---|---|
| | | 5.0 | 15 | 30 | 50 | 100 | 300 | 500 |
| Average grain diameter (μm) | 10 | unstable | unstable | unstable | unstable | unstable | unstable | unstable |
| | 20 | 3–4 | unstable | unstable | unstable | unstable | unstable | unstable |
| | 30 | 1–2 | 2–3 | 3–4 | unstable | unstable | unstable | unstable |
| | 50 | 1(stable) | 1–2 | 3–4 | unstable | unstable | unstable | unstable |
| | 70 | part of grains | 1(stable) | 1–2 | 2–3 | 3–4 | unstable | unstable |
| | 100 | part of grains | part of grains | 1(stable) | 1–2 | 3–4 | 3–4 | unstable |
| | 150 | glow | part of grains | part of grains | 1(stable) | 1–2 | 2–3 | 2–3 |
| | 200 | glow | glow | part of grains | part of grains | 1(stable) | 1–2 | 1–2 |
| | 300 | glow | glow | glow | glow | part of grains | 1(stable) | 1(stable) |
| | 500 | glow | glow | glow | glow | glow | part of grains | part of grains |

Unstable; arc spot moves in five minutes
Stable; arc spot does not move for more than 10 hours
Glow; no arc spot is generated, but whole electrode discharges (Relations of Average Grain Diameter and Lifetime of a Lamp)

Figure 19:
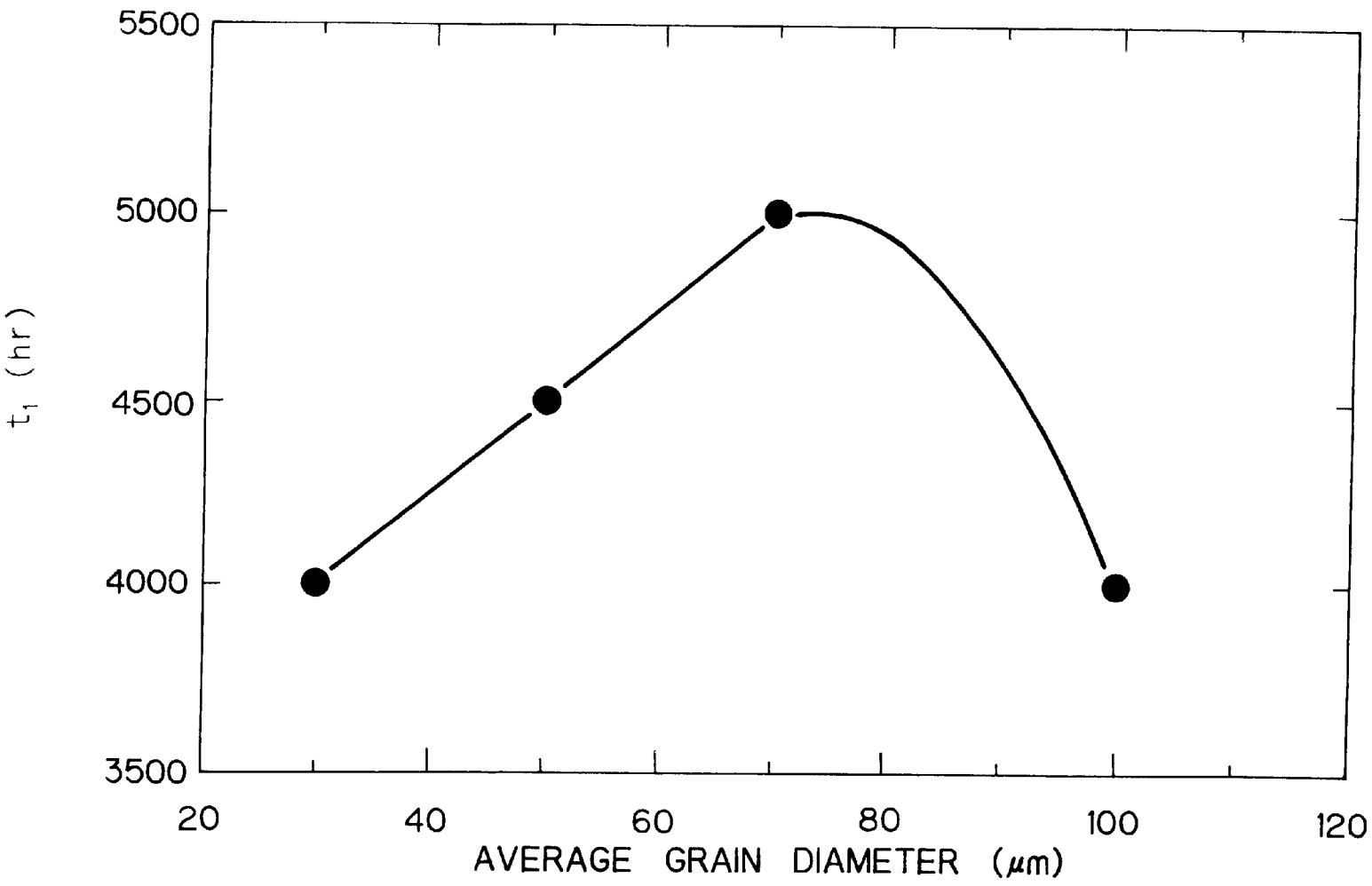

FIG. 19 shows the relationship between average grain diameter and lifetime $t_1$ when a fluorescent lamp having a cathode of the sample 18 in Table 14 is used, where the conditions for continuous test is the same as above. In FIG. 19, it is found that when tube current is 15 mA, and average grain diameter is 70 μm, the lifetime $t_1$ is the maximum. Also, as apparent in Table 18, an arc spot when tube current is 15 mA is the most stable when average grain diameter is 70 μm. When an arc spot is stable, no increase of tube wall occurs, and stable arc discharge is kept for a long time.

As described above, when a cathode material of a fluorescent lamp is determined by selecting grain diameter depending upon tube current, stable arc discharge with no black change and no temperature increase on a tube wall is kept for a long time.

EFFECT OF THE INVENTION

As described above, in a fluorescent lamp having a ceramic cathode, when gas sealing pressure is kept between 10 Torr and 170 Torr, a fluorescent lamp with high luminance and a long lifetime is obtained.

Further, a cathode for a fluorescent lamp according to the present invention provides less black change of the tube wall, no temperature increase on the tube wall, and stable arc discharge for a long time. Further, when grain diameter is selected depending upon tube current of a lamp, hot electron is effectively obtained, stable arc discharge is obtained with less movement of an arc spot.

What is claimed is:

1. A ceramic cathode fluorescent discharge lamp comprising:

a pair of electrodes, a bulb plated with a fluorescent body on an inner surface of the same, at least one of said pair of electrodes being a ceramic cathode having a bottomed cylindrical housing including an electron emission material of an aggregate type porous structure of conductive oxide having a first component consisting of at least one of Ba, Sr, and Ca, a second component consisting of at least one of Zr and Ti, and a third component consisting of at least one of Ta and Nb, said aggregate type porous structure having a surface plated with a conductive or semiconductive layer of at least one of carbide, nitride and oxide of Ta or Nb, rare gas being sealed in said bulb, and sealing pressure of said rare gas being in the range between 10 Torr and 170 Torr.

2. A ceramic cathode fluorescent discharge lamp according to claim 1, wherein said rare gas is one selected from pure Neon gas, pure Argon gas, pure Krypton gas, pure Xenon gas and mixtures of said gases.

3. A ceramic cathode fluorescent discharge lamp according to claim 1, wherein small amount of mercury is included in said bulb.

4. A ceramic cathode fluorescent discharge lamp according to claim 1, wherein said ceramic cathode has a first component including at least one of Ba, Sr and Ca, present in a concentration of x mole ratio in the form of BaO, SrO and CaO, respectively, a second component including at least one of Zr and Ti, present in a concentration of y mole ratio in the form of $ZrO_2$ and $TiO_2$, respectively, and a third component including at least one of Ta and Nb present in a concentration of z mole ratio in the form of (½) ($Ta_2O_5$) and (½) ($Nb_2O_5$), respectively, so that $0.8 =< x/(y+z) =< 2.0$, $0.05 =< y =< 0.6$ and $0.4 =< z =< 0.95$ are satisfied, said ceramic cathode having granulated particles with a diameter in the range of 20 μm and 300 μm with a surface formed of at least one of a carbide and nitride of Ta and Nb, and said ceramic cathode is mounted in a conductive housing.

5. A ceramic cathode fluorescent discharge lamp according to claim 1, wherein said aggregate type porous structure comprises granulated particles bonded to one another at contact points.

* * * * *